US005867196A

United States Patent [19]

Kiyohara et al.

[11] Patent Number: 5,867,196

[45] Date of Patent: Feb. 2, 1999

[54] SHEET SUPPLY APPARATUS FOR CONTROLLING SHEET FEEDING WITH REVERSING OF CONVEYANCE DIRECTION

[75] Inventors: Takehiko Kiyohara, Zama; Soichi Hiramatsu, Hachioji; Hideki Yamaguchi; Hiroyuki Inoue, both of Yokohama; Takashi Nojima, Mitaka; Hitoshi Nakamura, Kawasaki; Akira Kida, Yokohama; Hideaki Kawakami, Yokohama; Takeshi Iwasaki, Yokohama, all of Japan

[73] Assignee: Canon Kabushiki Kaisha, Tokyo, Japan

[21] Appl. No.: 507,082

[22] Filed: Jul. 26, 1995

[30] Foreign Application Priority Data

Jul. 29, 1994 [JP] Japan ..... 6-178486
Dec. 20, 1994 [JP] Japan ..... 6-316577

[51] Int. Cl.[6] ..... B41J 2/01

[52] U.S. Cl. ..... 347/104

[58] Field of Search ..... 400/636, 630, 400/636.2, 624, 629; 271/114, 116, 225, 902, 274; 347/104

[56] References Cited

U.S. PATENT DOCUMENTS 4,990,011 2/1991 Underwood et al. ..... 400/636
5,160,128 11/1992 Oishi ..... 271/114
5,594,486 1/1997 Kiyohara ..... 347/104
5,672,019 9/1997 Hiramatsu et al. ..... 400/624

*Primary Examiner*—Shawn Riley
*Attorney, Agent, or Firm*—Fitzpatrick, Cella, Harper & Scinto

[57] ABSTRACT

A sheet supply apparatus includes a sheet supporting device for supporting sheets, a sheet supply for positively contacting the sheet supported by the sheet supporting device and for feeding out the sheet, a release mechanism for releasing contact between the sheet supply and the sheet, a separation device for separating the sheets fed by the sheet supply one by one, a pair of convey rotary devices for conveying the separated sheet, and a controller. The controller effects control such that, after the sheet separated by the separation device is conveyed by a predetermined amount by the convey rotary devices, in a condition that the contact between the sheet supply and the sheet is released by the release mechanism, the sheet is conveyed in a reverse direction by the convey rotary devices until a tip end of the sheet leaves a nip of the convey rotary devices, and then the sheet is sent toward the nip of the convey rotary devices by the sheet supply to urge the tip end of the sheet against the nip of the convey rotary devices, which are now rotated in a reverse direction.

15 Claims, 23 Drawing Sheets

SHEET SUPPLY APPARATUS FOR CONTROLLING SHEET FEEDING WITH REVERSING OF CONVEYANCE DIRECTION

BACKGROUND OF THE INVENTION

1. Field of the Invention

The present invention relates to a sheet supply apparatus for supplying a sheet e.g., a recording sheet, a transfer sheet, a photo-sensitive sheet, an electrostatic recording sheet, a printing sheet, OHP sheet, an envelope, a post card, an original sheet, or the like) from a sheet stacking portion to a sheet treating portion (such as a recording portion, a reading portion, a working portion, or the like) in a recording apparatus (printer) acting as an information outputting apparatus of a word processor, a personal computer and the like, or in an image forming apparatus such as a copying machine, a facsimile and the like, or in other equipment using the sheet, and a recording apparatus having such a sheet supply apparatus.

2. Related Background Art

Conventionally, in sheet supply apparatuses of this kind, a function for surely separating a single sheet from a sheet stack and a function for conveying the separated sheet straightly in a conveying direction without skew-feed, to supply the sheet to a recording portion have been requested. Further, recently, there has been requested a technique in which many kinds of sheets such as a thin sheet, a thick sheet, a post card, an envelope, a resin film sheet and the like are supplied by using a single sheet supply apparatus.

An example of a conventional technique is disclosed in the Japanese Patent Publication No. 58-6633 (1983). In this technique, a driving force of a printing cylinder is transmitted to a separation roller of a sheet supply apparatus through a one-way clutch. Upon the supply of a sheet, by rotating the printing cylinder in a reverse direction, the separation roller is rotated in a sheet supplying direction to feed out the sheet until the sheet abuts against an entrance (nip) of the printing cylinder and then is flexed in a curved fashion. In this way, a tip end of the sheet is aligned with the nip of the printing cylinder, thereby correcting the skew-feed of the sheet.

Then, when the printing cylinder is rotated in a normal direction, the rotating force of the printing cylinder is not transmitted to the separation roller due to the presence of the one-way clutch and is maintained in the stopped condition, so that the sheet is pulled into the nip of the printing cylinder by a restoring force of the sheet for returning the sheet to its initial flat condition, with the result that the sheet is conveyed to the recording portion in the straight condition.

Further, another example of a conventional technique is disclosed in the Japanese Patent Publication No. 62-38261 (1987). In this technique, a sheet fed by a pick-up roller is conveyed until a tip end of the sheet reaches a predetermined position after it passes through a contact position (nip) between a pair of drive rollers, and then, the sheet is conveyed in a reverse direction until the tip end of the sheet passes through the contact position, so that the sheet is flexed in a curved fashion between the pick-up roller and the drive rollers to abut the tip end of the sheet against the contact position, thereby correcting skew-feed of the sheet. Thereafter, when the drive rollers are rotated, the sheet is pulled between the drive rollers by a restoring force of the sheet for returning the sheet to its initial flat condition.

However, in the conventional sheet supply apparatus wherein the skew-feed of the sheet is corrected by abutting the sheet against the printing cylinder, if the tip end of the sheet does not enter into the entrance of the printing cylinder straightly (parallel with the entrance), when the tip end of the sheet impinges the printing cylinder, the sheet will be kicked back or the tip end of the sheet will be folded, thereby causing poor sheet supply.

Further, in the above-mentioned conventional sheet supply apparatuses, the skew-feed of the sheet is corrected by flexing the sheet and the sheet is pulled into the printing cylinder or the drive rollers by the restoring force of the sheet for returning the sheet to its initial flat condition, with the result that the sheet must be flexed to obtain the restoring force. However, as mentioned above, recently, since many kinds of sheets are used, for example, if the post card or the envelope is used, it will be folded when it is flexed. Thus, the kind of the sheets to be supplied is limited.

SUMMARY OF THE INVENTION

The present invention intends to eliminate the above-mentioned conventional drawbacks, and an object of the present invention is to provide a sheet supply apparatus in which the kind of sheets to be supplied is not limited and which can positively correct skew-feed of the sheet.

To achieve the above object, the present invention provides a sheet supply apparatus comprising a sheet supporting means for supporting sheets, a sheet supply means for contacting with the sheet supported by the sheet supporting means and for feeding out the sheet, a release means for releasing the contact between the sheet supply means and the sheet, a separation means for separating the sheets fed by the sheet supply means one by one, a pair of convey rotary means for conveying the sheet separated by the separation means, and a control means for effecting control in such a manner that, after the sheet separated by the separation means is conveyed by a predetermined amount by means of the convey rotary means, in a condition that the contact between the sheet supply means and the sheet is released by the release means, the sheet is conveyed in a reverse direction by means of the convey rotary means until a tip end of the sheet leaves a nip of the convey rotary means, and then the sheet is sent toward the nip of the convey rotary means by means of the sheet supply means to urge the tip end of the sheet against the tip of the convey rotary means which are now rotated in the reverse direction.

Further, the present invention provides a sheet supply apparatus wherein the control means effects control in such a manner that, after the tip end of the sheet abuts against the nip of the convey rotary means, the sheet is conveyed toward a downward direction by rotating the sheet supply means and the convey rotary means in a normal direction.

With the arrangement as mentioned above, the sheet fed by the sheet supply means and separated by the separation means is conveyed by the predetermined amount in the sheet conveying direction by means of the convey rotary means, and, then, by releasing the contact between the sheet supply means and the sheet, a condition results that no load is applied to the sheet. In this condition, the sheet is conveyed in the reverse direction by rotating the convey rotary means reversely until the tip end of the sheet leaves the nip of the convey rotary means, and, then, the tip end of the sheet is urged against the nip of the convey rotary means which are now rotated in the reverse direction. In this way, the skew-feed of the sheet is corrected. In this case, since the tip end of the sheet returned to the reverse direction is positioned near the nip of the convey rotary means, when the tip end of the sheet is urged against the nip of the convey rotary means which are now rotated in the reverse direction, the tip end of the sheet can correctly be urged against the nip, thereby preventing kick-back of the sheet and folding of the sheet.

Further, in the case where the sheet is conveyed after the tip end of the sheet is urged against the nip of the convey rotary means, when both the convey rotary means and the sheet supply means are rotated in the normal direction, since there is no need for flexing the sheet to urge the tip end of the sheet against the nip of the convey rotary means by a restoring force of the sheet, regarding a thick sheet such as a post card or an envelope, the skew-feed of the sheet can be corrected without any problem.

DETAILED DESCRIPTION OF THE PREFERRED EMBODIMENTS

Figure 1:
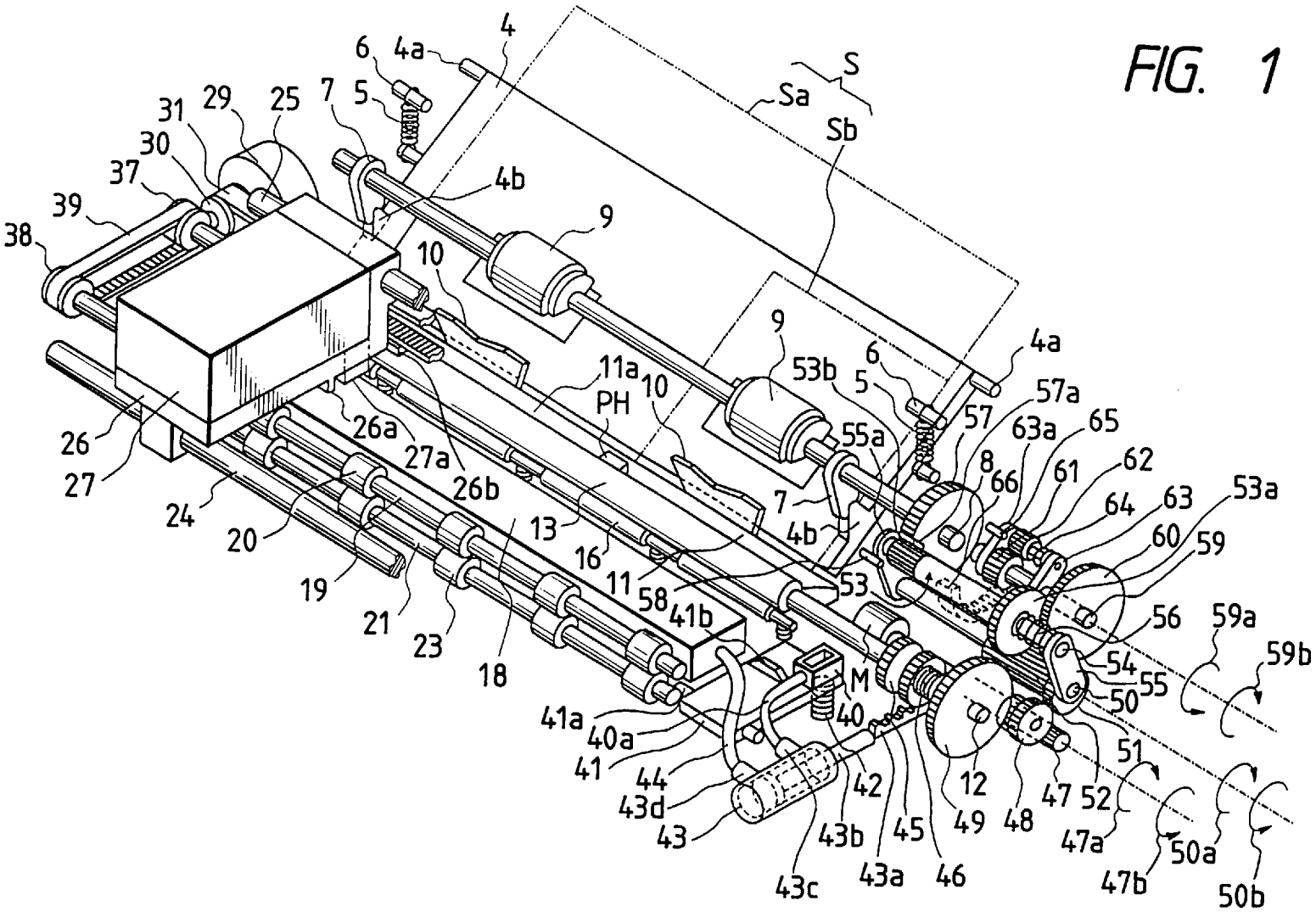
FIG. 1 is a perspective view of a recording apparatus having a sheet supply apparatus according to a first embodiment of the present invention.
Figure 2:
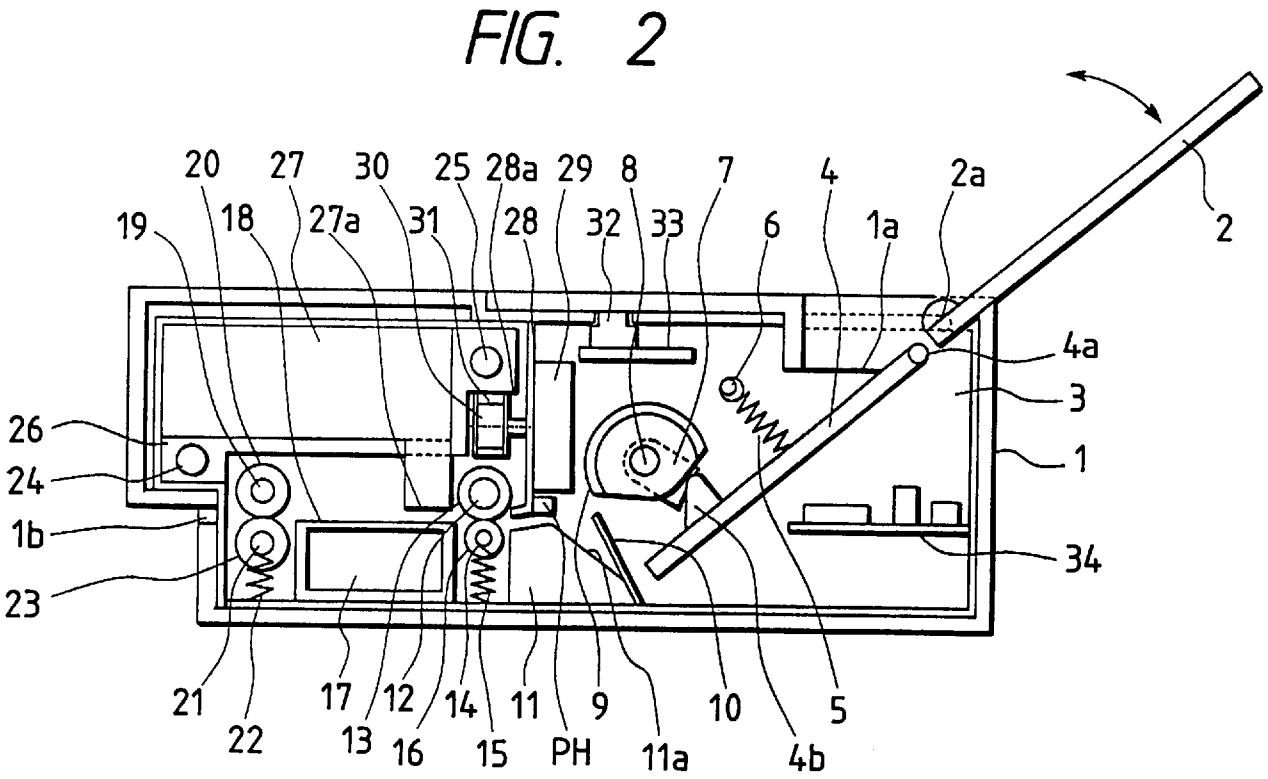
FIG. 2 is an elevational sectional view of the recording apparatus.

FIGS. 1 and 2 show a first embodiment of the present invention which is applied to an ink jet printer having an ink jet recording means, where FIG. 1 is a schematic perspective view of the printer, and FIG. 2 is sectional view of the printer.

In FIG. 2, the printer has a cover 1, and a lid 2 pivotally mounted on a shaft 2*a* and also acting as a sheet tray. Sheets are inserted through an insertion opening 1*a* formed in the cover 1 and are discharged from a discharge opening 1*b*. Within a plurality of side plates 3 provided on the cover 1, there are provided a sheet stacking plate (sheet stacking means) 4 pivotally mounted on a shaft 4*a* and biased (upwardly) toward a sheet supply roller 9 by a spring 5 having one end connected to a pin 5, sheet supply rollers (sheet supply means) 9 each having a large diameter portion capable of being contacted with the sheet and a small diameter portion not contacted with the sheet, drive cams 7 secured to a shaft 8 and engaged by cam follower portions 4*b* provided on left and right ends of the sheet stacking plate 4 to push the sheet stacking plate 4 downwardly, abutment members (separation means) 10 acting as separation members for separating the sheets one by one when it is flexed by the sheets supplied by the sheet supply rollers 9, and a guide member 11 having a surface 11*a* for lifting a tip end of the sheet separated by the abutment members 10 and adapted to separate the sheet from the tip ends of the abutment members 10 by lifting the sheet by the surface 11*a*.

Further, at a downstream side of the guide member 11, there are provided a photo-sensor (sheet detection means) PH having a light emitting portion and a light receiving portion and adapted to detect the tip end rear ends of the sheet on the basis of the presence/absence of the light, a convey roller (convey means) 13 secured to a shaft 12 and adapted to convey the sheet supplied by the sheet supply rollers 9 and guided by an upper guide 28*a* and the guide member 11 at a constant speed, first pinch rollers 16 rotatably mounted on a shaft 14 and urged against the convey roller 13 by springs 15 via the shaft 14, a platen 18 including ink absorbing material 17 therein, discharge rollers 20 secured to a shaft 19 and adapted to discharge the sheet on which an image was recorded, second pinch rollers 23 rotatably mounted on a shaft 21 and urged against the discharge rollers 20 by springs 22 via the shaft 21, a carriage 26 guided by guide shafts 24, 25 and shiftable in a widthwise direction of the sheet, and a recording head 27 mounted on the carriage 26 and adapted to discharge ink from a discharge portion 27*a* to record the image on the sheet in response to image information. The carriage 26 is driven by a motor 29 provided on a central side plate 28 having the upper guide 28*a*, a pulley 30 secured to an output shaft of the motor 29, and a belt 31 mounted around the pulley 30 and having one end secured to the carriage 26.

Further, within the case 1, there are provided an electric operation substrate 33 having a plurality of switch buttons 32 protruded from holes formed in the case 1, and an electric control substrate (control means) 34 disposed below the sheet stacking plate 4 and having a micro-computer and memories to control the operation of the ink jet printer.

Next, a switching means for engaging the sheets stacked on the sheet stacking plate 4 and the sheet supply rollers 9 or disengaging the sheets from the sheet supply rollers 9 will be explained with reference to FIG. 1.

The drive cams (cam members) 7 secured to the shaft 8 of the sheet supply rollers 9 are urged against the corresponding cam follower portions 4*b* provided on the sheet stacking plate 4 at predetermined positions by the springs 5 so that the cams 7 are rotated in synchronous with the sheet supplying operation of the sheet supply rollers 9 to lift or lower the sheet stacking plate 4, thereby engaging the sheets by the sheet supply rollers 9 or disengaging the sheets from the sheet supply rollers.

Since a pulley 37 provided on one end of the shaft 12 of the convey roller is connected to a pulley 38 provided on one end of the shaft 19 of the discharge rollers via a belt 39, a rotational force of a motor (drive source) M is transmitted to the discharge rollers 20 via the shaft 12.

A cap support 41 having a cap 40 for covering the ink discharge portion 27*a* of the recording head 27 is disposed at an opposite side of the motor with the interposition of the sheet conveying path. The cap support 41 has a rotary shaft 41*a* and a push-down cam portion 41*b* and is biased to be rotated around the shaft 41*a* in an anti-clockwise direction by a spring force of a spring 42. As the carriage 26 is shifted, when a projection 26*a* of the carriage 26 is contacted with the push-down cam portion 41*b*, the cap support 41 is pushed downwardly in opposition to the force of the spring 42, thereby lowering the cap 40. After the projection 26*a* passes through the push-down cam portion 41*b*, the cap 40 is lifted to closely cover the ink discharge portion 27*a*.

A pump 43 has a piston shaft 43*b* having a rack 43*a*, a suction port 43*c* and a discharge port 43*d*. The suction port 43*c* is connected to the cap 40 through a tube 40*a*, and the discharge port 43*d* is connected to the platen 18 through a tube 44 so that the ink sucked from the cap 40 is discharged onto the ink absorbing material 17.

A pump drive gear 45 with which the rack 43*a* of the pump 43 can be engaged is mounted on the shaft 12 in such a manner that it can be shifted along the shaft 12 and be rotated together with the shaft 12. The pump drive gear is biased toward a position where the gear is not engaged by the rack 43*a*, by a spring 46.

A solid component of the ink is apt to adhere to the neighborhood of the ink discharge openings to cause poor ink discharge. If poor ink discharge occurs, in order to perform a poor ink discharge recovery operation, under the control of the controller 34, the carriage 26 is shifted by the motor 29 to contact the discharge portion 27*a* with the cap 40. When the carriage 26 is shifted, since the projection 26*b* of the carriage 26 shifts the pump drive gear 45 to a position shown by the two-dot and chain line, the pump drive gear 45 is meshed with the rack 43*a*. In this condition, when the gear 45 is rotated by the motor M within a predetermined rotational angle in the normal and reverse directions alternately by a predetermined number of cycles, the rack 43*a* is reciprocally shifted along a straight line by the same predetermined number of cycles. Since the reciprocal movement of the rack 43*a* causes reciprocal movement of a piston connected to the piston shaft 43*b*, the pump 43 absorbs or sucks the ink and its solid component from the ink discharge portion 27*a*, and the absorbed matters are discharged onto the ink absorbing material 17 in the platen 18.

Next, a drive transmitting mechanism for transmitting the rotational force of the motor M to the sheet supply rollers 9 and the convey roller 13 will be explained.

Under the control of the controller 34, the motor M rotates the pair of convey rollers 13, 16 through an output gear 47 mounted on the output shaft, a two-stage gear 48 and a convey roller gear 49 secured to the shaft 12, thereby conveying the sheet. On the other hand, the motor M also rotates a gear 51 secured to a shaft 50 through the output gear 47 and the two-stage gear 48. A first planetary gear 53 meshed with a first sun gear 52 secured to the shaft 50 comprises a large planetary gear 53*a* and a small planetary gear 53*b*, and a shaft 54 of the first planetary gear 53 is supported by a first carrier 55 which is rotated around the shaft 50.

Since the first planetary gear 53 is urged against one of arm members 55*a* of the first carrier with a predetermined pressure by a spring 56 mounted around the shaft 54, when the first planetary gear 53 is rotated, a certain load is applied to the first planetary gear.

Figure 3:
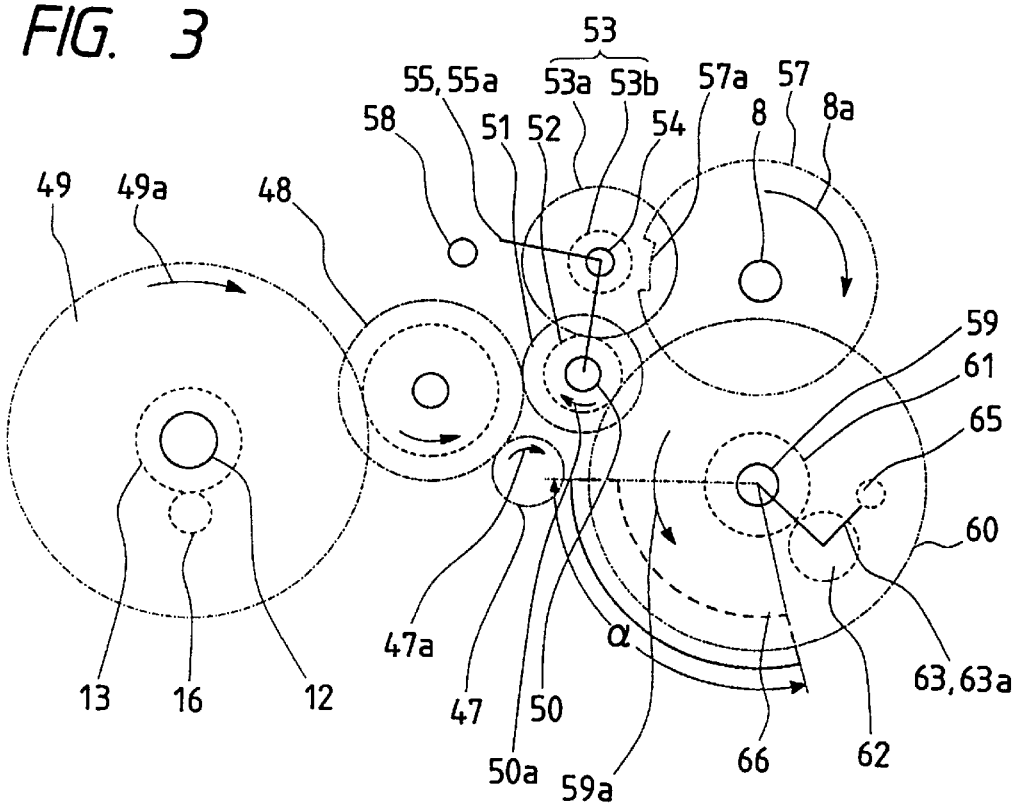
FIG. 3 is an explanatory view showing a normal rotation condition in a drive transmission mechanism of the sheet supply apparatus.

In FIGS. 1 and 3, when the output gear 47 provided on the shaft of the motor M is rotated in a direction shown by the arrow 47*a*, the first sun gear 52 is rotated in a direction shown by the arrow 50*a*.

When the large planetary gear 53*a* meshed with the first sun gear 52 is rotated, since a certain load is applied to the large planetary gear, the first planetary gear 53 is not rotated, but is revolved around the first sun gear 52 in a direction shown by the arrow 50*a*. Due to this revolution, since the first carrier 55 is also rotated in the direction shown by the arrow 50*a*, the small planetary gear 53*b* is engaged by a gear 57 secured to the shaft 8 of the sheet supply rollers, with the result that the rotational force of the motor M is transmitted to shaft 8, thereby rotating the sheet supply rollers 9 in a sheet supplying direction 8*a*.

The gear 57 has a non-toothed portion 57*a*. As the gear 57 is rotated, when the non-toothed portion 57*a* is opposed to the small planetary gear 53*b*, the small planetary gear 53*b* is rotated idly, with the result that the rotational force is not transmitted to the gear 57. Consequently, the gear is stopped and the rotation of the sheet supply rollers 9 in the sheet supplying direction 8*a* is also stopped.

Figure 4:
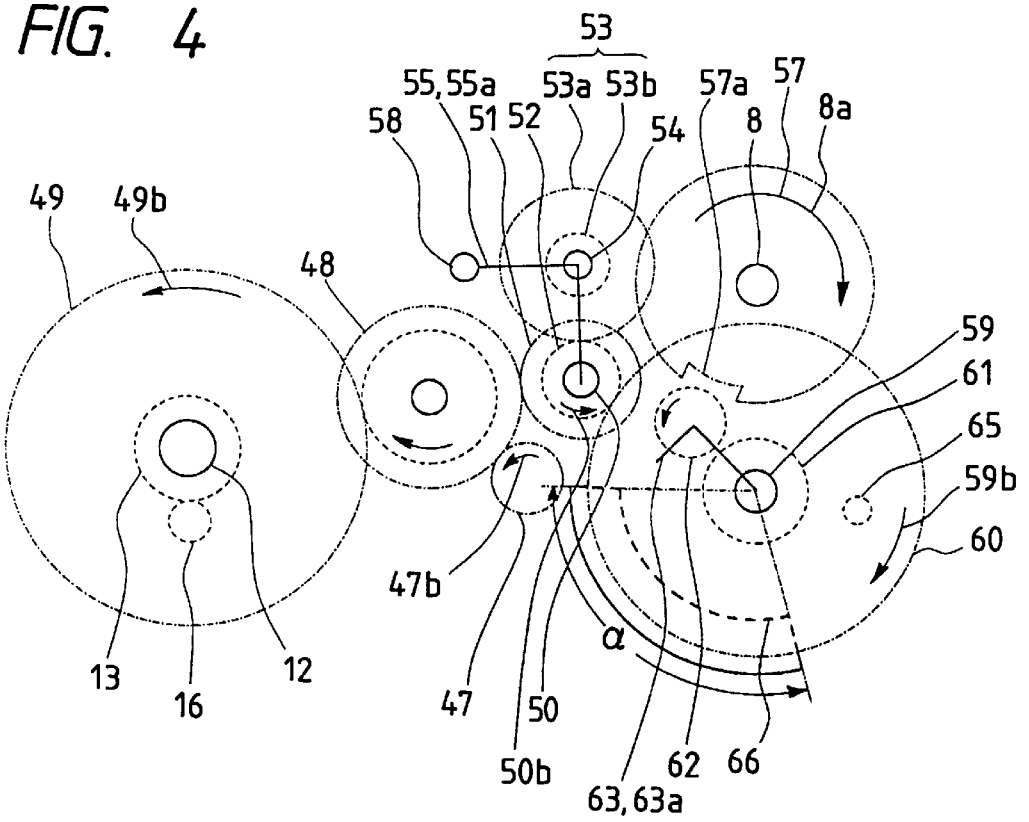
FIG. 4 is an explanatory view showing a reverse rotation condition in the drive transmission mechanism of the sheet supply apparatus.

In FIGS. 1 and 4, when the motor M is rotated in a direction shown by the arrow 47*b*, the first sun gear 52 is rotated in a direction shown by the arrow 50*b*. By this rotation, the first carrier 55 and its arm portions 55*a* are rotated together with the first planetary gear 53 in the direction shown by the arrow 50*b*. When the first carrier 55 is rotated in the direction 50*b*, the small planetary gear 53*b* is disengaged from the gear 57. As a result, one of the arm portions 55*a* is contacted with a pin 58, thereby stopping the first carrier 55. In a condition that the first carrier 55 is stopped, the small planetary gear 53*b* is rotated idly during the rotation of the first sun gear 52 in the direction 50*b*.

A gear 60 meshed with the first sun gear 52 and a second sun gear 61 are secured to a shaft 59. A second planetary gear 62 meshed with the second sun gear 61 is supported by a second carrier 63 which can freely be rotated around the shaft 59. Since the second planetary gear 62 is urged against one of arm members 63*a* of the second carrier with a predetermined pressure by a spring 64, when the second planetary gear 62 is rotated, a certain load is applied to the second planetary gear.

In FIGS. 1 and 3, when the motor M is rotated in the direction 47*a*, the gear 60, shaft 59 and second sun gear 61 are rotated in a direction shown by the arrow 59*a*. As a result, the second carrier 63 is also rotated together with the second planetary gear 62 in the direction 59*a* until the arm member 63*a* of the second carrier is contacted with a pin 65. In the condition that the second carrier 63 is stopped, the further rotation of the sun gear 61 causes idle rotation of the second planetary gear 62.

In FIGS. 1 and 4, when the motor M is rotated in the direction 47*b*, the sun gear 61 is rotated in a direction shown by the arrow 59*b*. As a result, the second carrier 63 is rotated together with the second planetary gear 62 in the direction 59*b*, with the result that the second planetary gear 62 is engaged by the notched gear 57. In this way, the rotation of the second sun gear 61 in the direction 59*b* is transmitted to the shaft 8, thereby rotating the sheet supply rollers 9 in the sheet supplying direction 8*a*.

As the gear 57 is further rotated by the second planetary gear 62, when the non-toothed portion 57*a* of the gear 57 is opposed to the second planetary gear 62, the second planetary gear 62 is idly rotated not to transmit the rotational force to the gear 57. Within a predetermined angle range $\alpha$ of a so-called non-synchronous zone in which the second planetary gear 62 is not engaged with the notched gear 57 while the second planetary gear 62 is completely revolved around the second sun gear 61, the second planetary gear 62 is engaged with an inner gear 66. Due to this engagement, the second planetary gear 62 is revolved around the second sun gear 61 while being rotated.

In FIG. 1, when the pump 43 is operated by the alternate normal and reverse rotations of the motor M by the predetermined amount, in order to prevent the engagement between the gear 57 and the second planetary gear 62, the above-mentioned non-synchronous zone is used.

In the illustrated embodiment, when the motor M is rotated by a predetermined amount to effect the above operation, the non-synchronous zone of 360° is required. However, if the second planetary gear 62 is revolved without rotation, it is impossible to provide the non-synchronous zone of 360°.

Thus, by providing the inner gear 66, the second planetary gear 62 can be rotated and the revolving speed of the second planetary gear can be reduced. In this way, it is possible to set the non-synchronous zone. Now, this will be explained. When it is assumed that the number of teeth of the second sun gear 61 is $Z_1$, the number of teeth of the second planetary gear 62 is $Z_2$ and the number of teeth of the inner gear 66 is $Z_3$, the following relation is established:

$$Z_3=Z_1+2Z_2.$$

Accordingly, the reduction ratio between the tooth number $Z_1$ and the tooth number $Z_3$ becomes as follows:

$$Z_1/Z_3=1/1+2(Z_2/Z_1).$$

That is to say, when the second sun gear 61 is rotated within the angular range $\alpha$ of the toothed inner gear 66, the second planetary gear 62 is revolved by $\alpha/1+2(Z_1/Z_2)$, thereby greatly reducing the revolving speed. For example, when $\alpha=120°$, $Z_1=10$ and $Z_2=10$, revolving angle $\beta$ of the second planetary gear 62 becomes as follows:

$$\beta=120°/3=40°.$$

On the other hand, in order to revolve the second planetary gear 62 by 120°, the second sun gear 61 is rotated by 360° (=120°×3), and, thus, the required non-synchronous zone can be set to 120°.

Next, the sheet supplying operation and recording operation according to the first embodiment will be explained with reference to FIGS. 1 to 4 and FIGS. 5 to 10.

First, of all, to perform an initializing operation, when the power source is turned ON, in response to an initialization command from the controller 34 of FIG. 2, the motor M of FIG. 1 is rotated in the direction 47*a* (i.e., the convey roller 13 is rotated to convey the sheet toward the discharge opening 16) by a predetermined amount. As a result, the drive transmitting portion reaches a condition that the rotational force of the motor M of FIGS. 3 and 5 is not transmitted to the sheet supply rollers 9, and the sheet supplying portion becomes a condition shown in FIG. 5.

Figure 5:
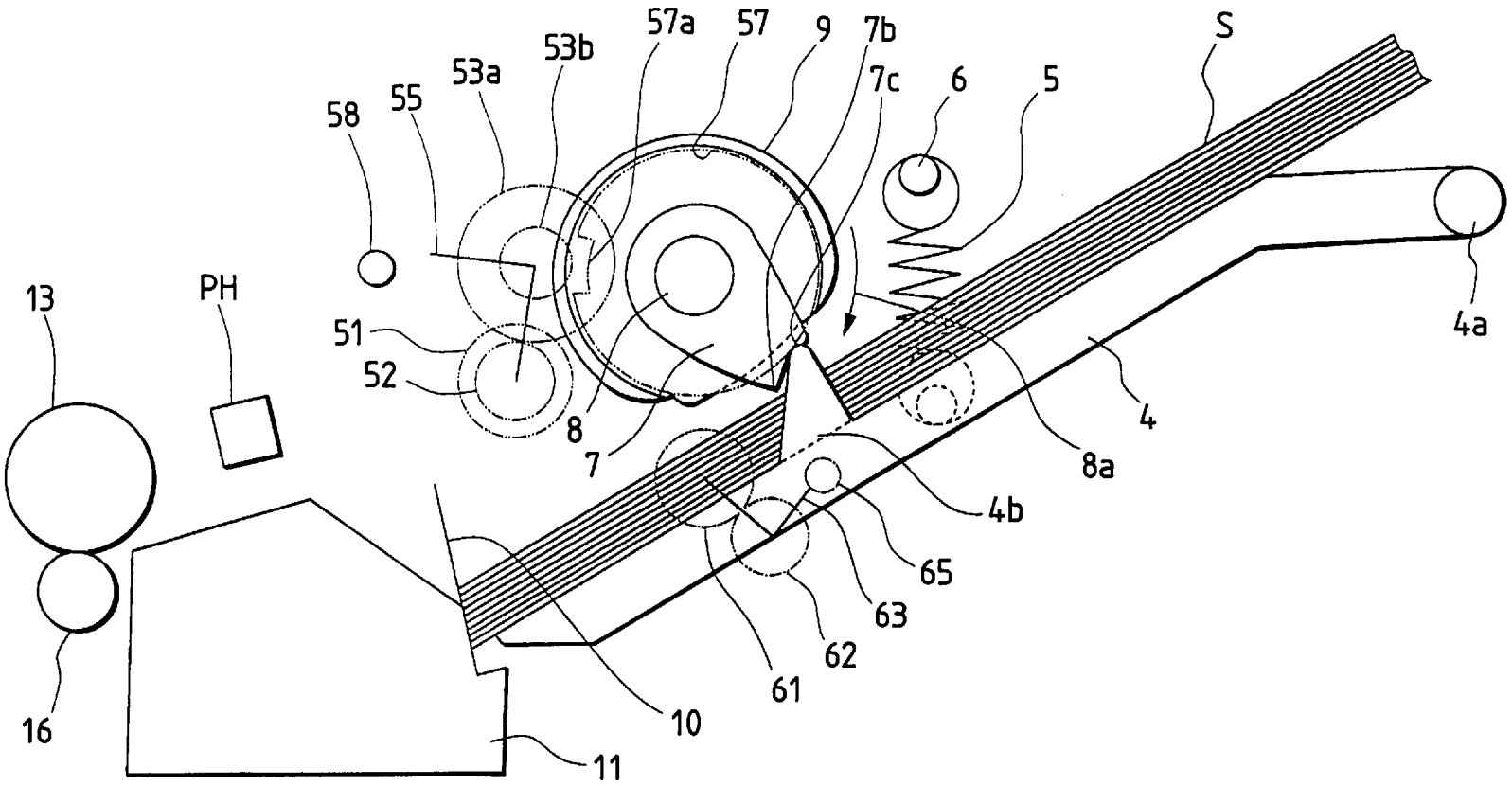
FIG. 5 is a side view of the sheet supply apparatus showing a condition that sheets are not yet separated.

In FIG. 5, in a condition that a stop position lift surface 7*b* of the drive cam 7 is engaged by the cam follower portion 4*b* of the sheet stacking plate 4 by the force of the spring 5, the sheet stacking plate 4 is located at the lowered position. In this condition, a plurality of sheets S are stacked on the sheet stacking plate 4 with tip ends of the sheets contacted with a lower portion of the abutment members 10.

Figure 6:
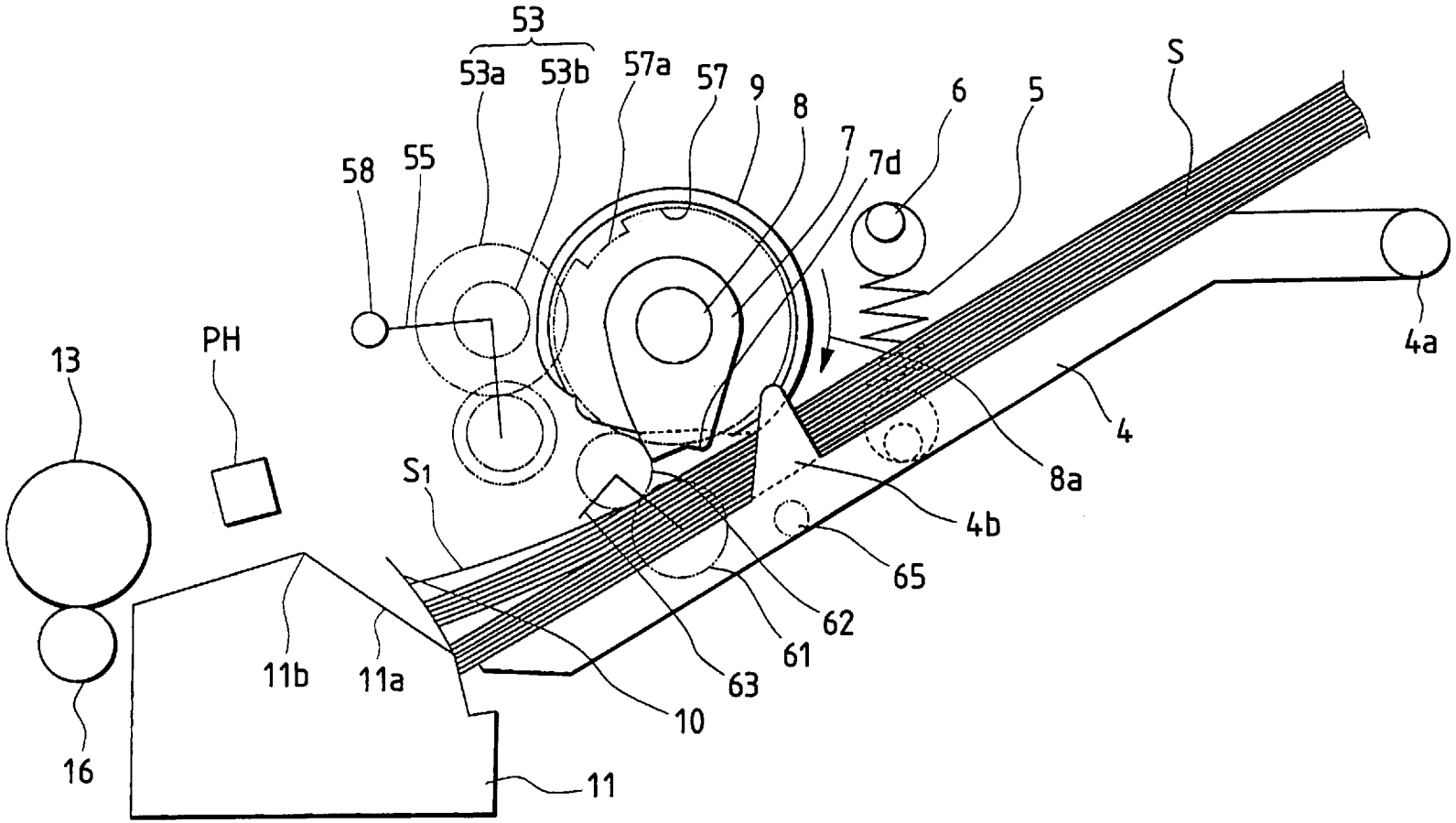
FIG. 6 is a side view of the sheet supply apparatus showing a condition that sheets are being separated.

In FIGS. 4 and 6, when the motor M is rotated in the direction 47*b* by a predetermined amount in response to the sheet supply command, the second planetary gear 62 is revolved from a position when the second carrier 63 is contacted with the pin 65 to a position where the second planetary gear is engaged by the gear 57. When the second planetary gear is engaged by the gear 57, since the rotation of the motor M in the direction 47*b* is transmitted to the gear 57, the sheet supply rollers 9 are rotated in the sheet supplying direction 8*a* via the shaft 8.

On the other hand, when the motor M is rotated in the direction 47*b*, the first planetary gear 53 is rolled around the first sun gear 52 in the direction 50*b* to be disengaged from the gear 57. When the gear 57 is rotated, since the drive cam 7 secured to the shaft 8 is rotated in the direction 8*a*, the stop position lift surface 7*b* of the drive cam 7 is disengaged from the cam follower portion 4*b* of the sheet stacking plate 4, with the result that the sheet stacking plate 4 is lifted by the force of the spring 5.

In FIG. 6, when the sheet stacking plate 4 is lifted, since the uppermost sheet $S_1$ on the sheet stack S is urged against the sheet supply roller 9 which is now rotated, the uppermost sheet $S_1$ is supplied toward the abutment members 10. The abutment members 10 are flexed toward the sheet advancing direction by the moving force of the sheet stack S after the sheet stack S abuts against the abutment members. As a result, the uppermost sheet $S_1$ is separated from the sheet stack S by the flexion or angular displacement of the abutment members 10.

Figure 7:
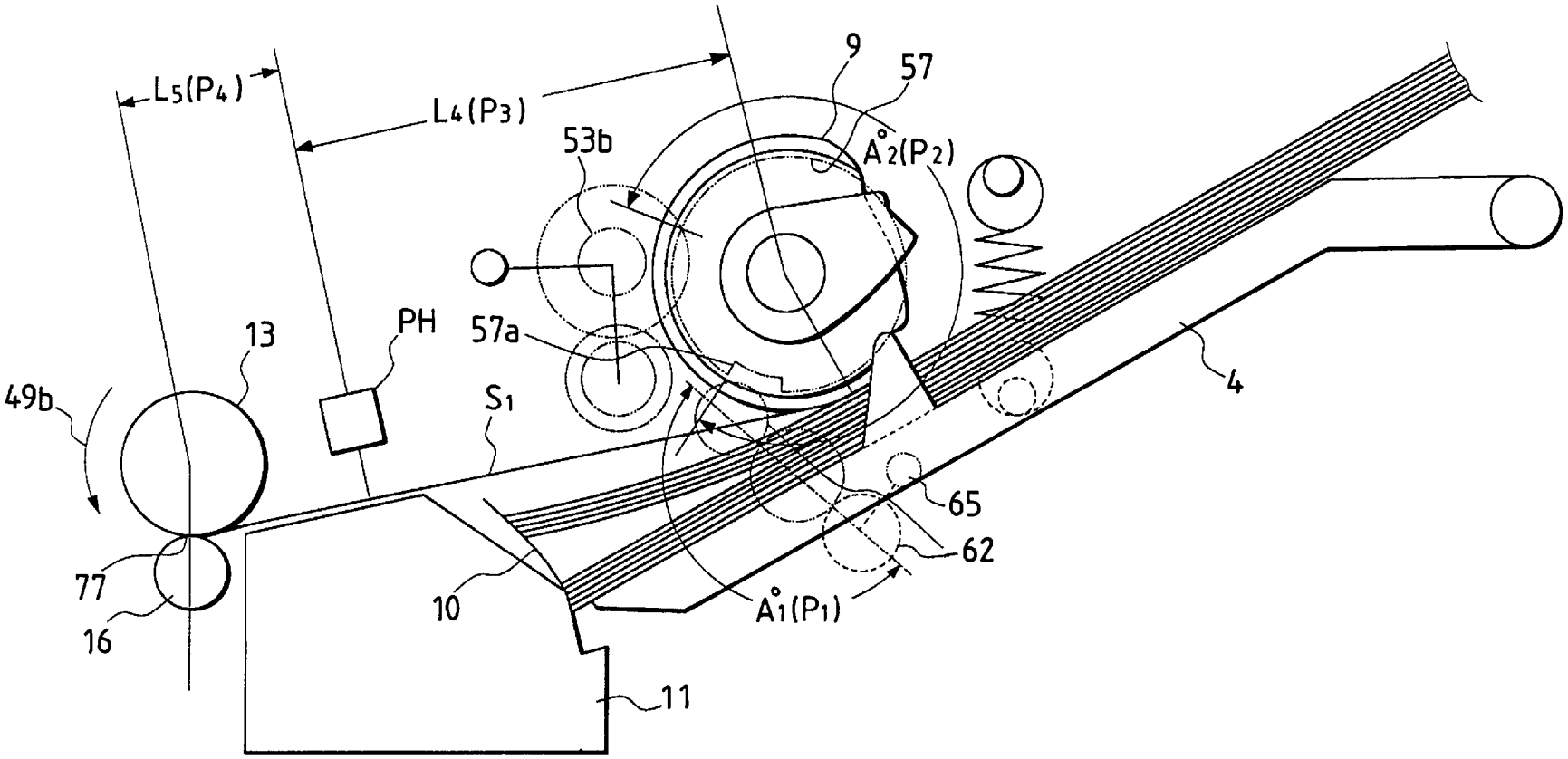
FIG. 7 is a side view of the sheet supply apparatus showing a feed amount of sheets obtained by a sheet supply roller.

In FIG. 7, the tip end of the sheet $S_1$ which rides over the abutment members 10 is guided by the inclined surface 11*a* of the guide member 11 to be directed upwardly. When the tip end of the sheet $S_1$ is lifted in this way, the tip end rides over the apex 11*b* and then is shifted toward a contact position (nip) 77 between the convey roller 13 and the first pinch roller 16.

When the tip end of the separated sheet passes through the photo-sensor PH, the signal is generated by the photo-sensor PH. On the basis of this signal, the controller 34 of FIG. 2 causes the motor M to rotate by the number $P_4$ of pulses corresponding to the distance $L_5$. Thereafter, the motor is temporarily stopped. When the motor is rotated by the number $P_4$ of pulses, the sheet supply roller 9 is also rotated accordingly to bring the tip end of the sheet $S_1$ to the vicinity of the contact position 77 between the convey roller 13 rotated reversely in the direction shown by the arrow 49*b* and the first pinch roller 16. In the above condition, since the non-toothed portion 57*a* of the gear 57 is opposed to the second planetary gear 62, the transmission of the force is prevented, thereby stopping the sheet supply roller 9.

Figure 8:
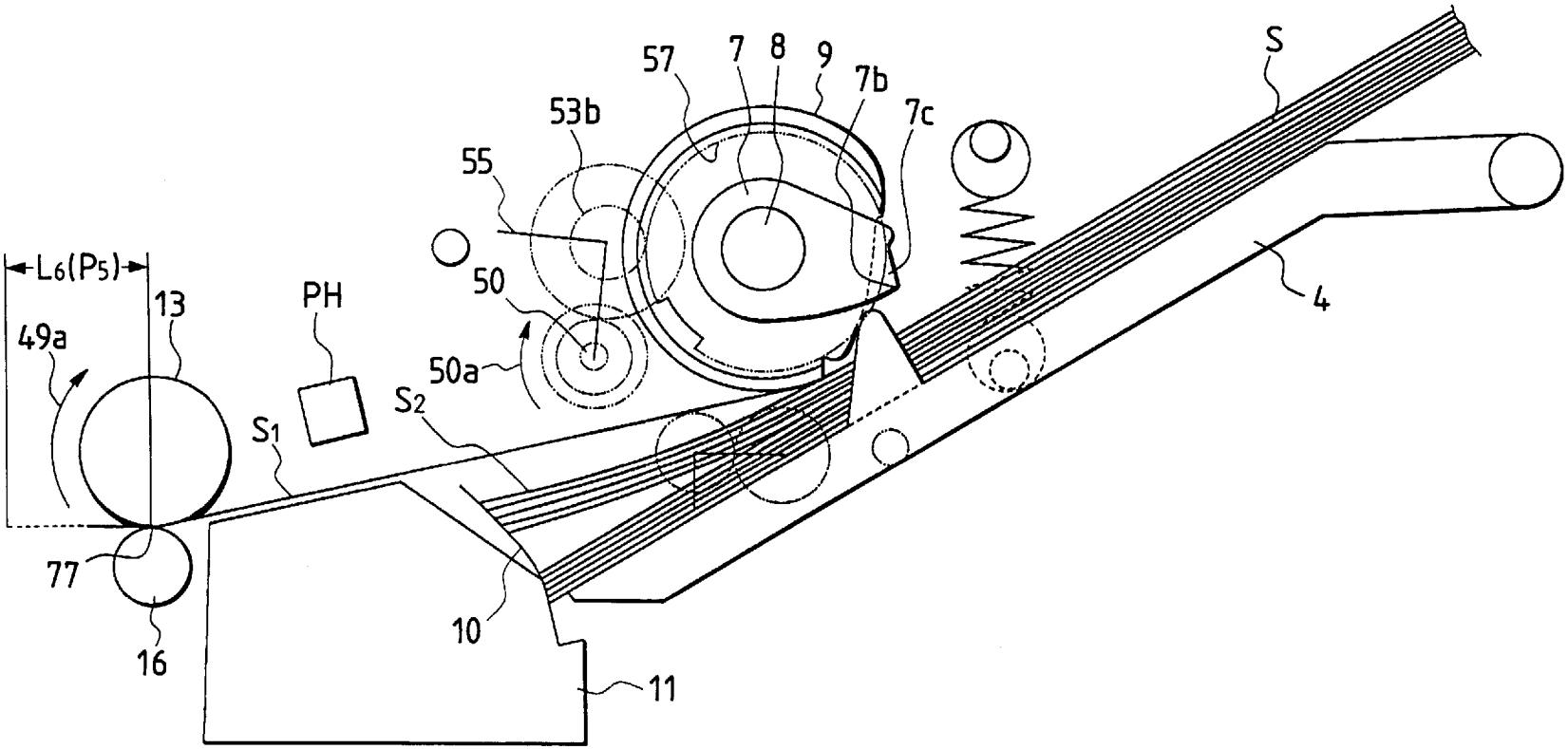
FIG. 8 is a side view of the sheet supply apparatus showing a condition that the sheets are conveyed by a predetermined amount by means of a convey roller.

In FIG. 8, after the motor is rotated by the number $P_4$ of pulses, when the motor M is rotated in the normal direction shown by the arrow 47*a* by the number $P_5$ of pulses corresponding to the distance $L_6$ through which the sheet is conveyed by the convey roller 13 (i.e., the condition shown in FIG. 4 is changed to the condition shown in FIG. 3), the first planetary gear 53 is engaged by the gear 57. When the motor M is rotated by the number $P_5$ of pulses, the sheet supply roller 9 is further rotated to enter the tip end of the sheet $S_1$ into the contact position 77, with the result that the tip end of the sheet $S_1$ is conveyed by the distance $L_6$ by the rotation of the convey roller 13 in the direction 49*a*.

Figure 9:
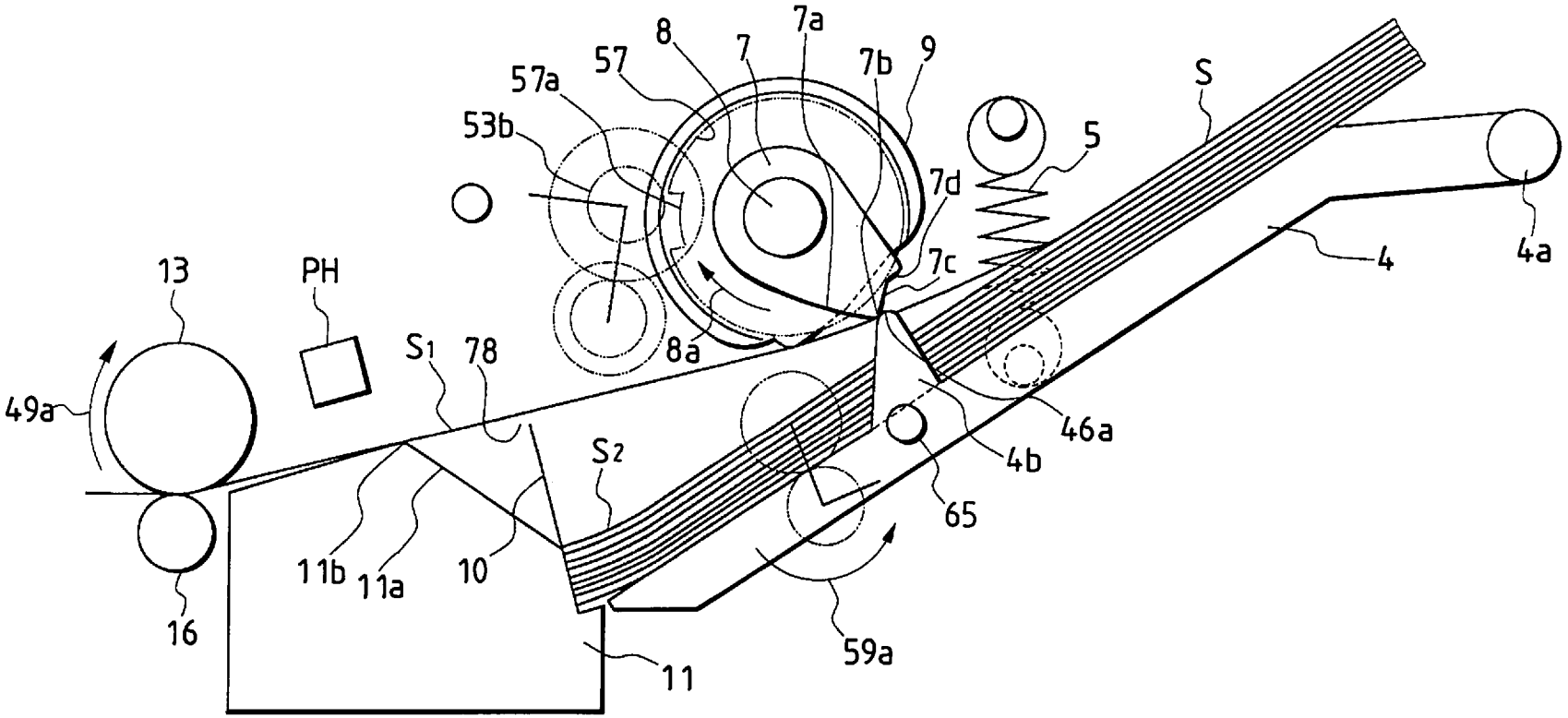
FIG. 9 is a side view of the sheet supply apparatus showing a condition that the sheets are separated from the sheet supply roller on the way that the sheets are conveyed by the predetermined amount by means of the convey roller.

In FIG. 9, while the motor M is being rotated by the number $P_5$ of pulses, since the maximum lift profiles 7*b* of the cam members 7 mounted on the shaft 8 push down protruded portions 46*a* of the cam followers 4*b* in opposition to the force of the springs 5, the sheet stacking plate 4 is lowered. As a result, the sheet $S_2$ positioned below the uppermost sheet $S_1$ is separated from the sheet supply roller 9 and then is returned to its initial position (FIG. 5) by the restoring force of the abutment members 10. Other hand, the second planetary gear 62 is revolved in the direction shown by the arrow 59*a* to abut against the pin 65.

Figure 10:
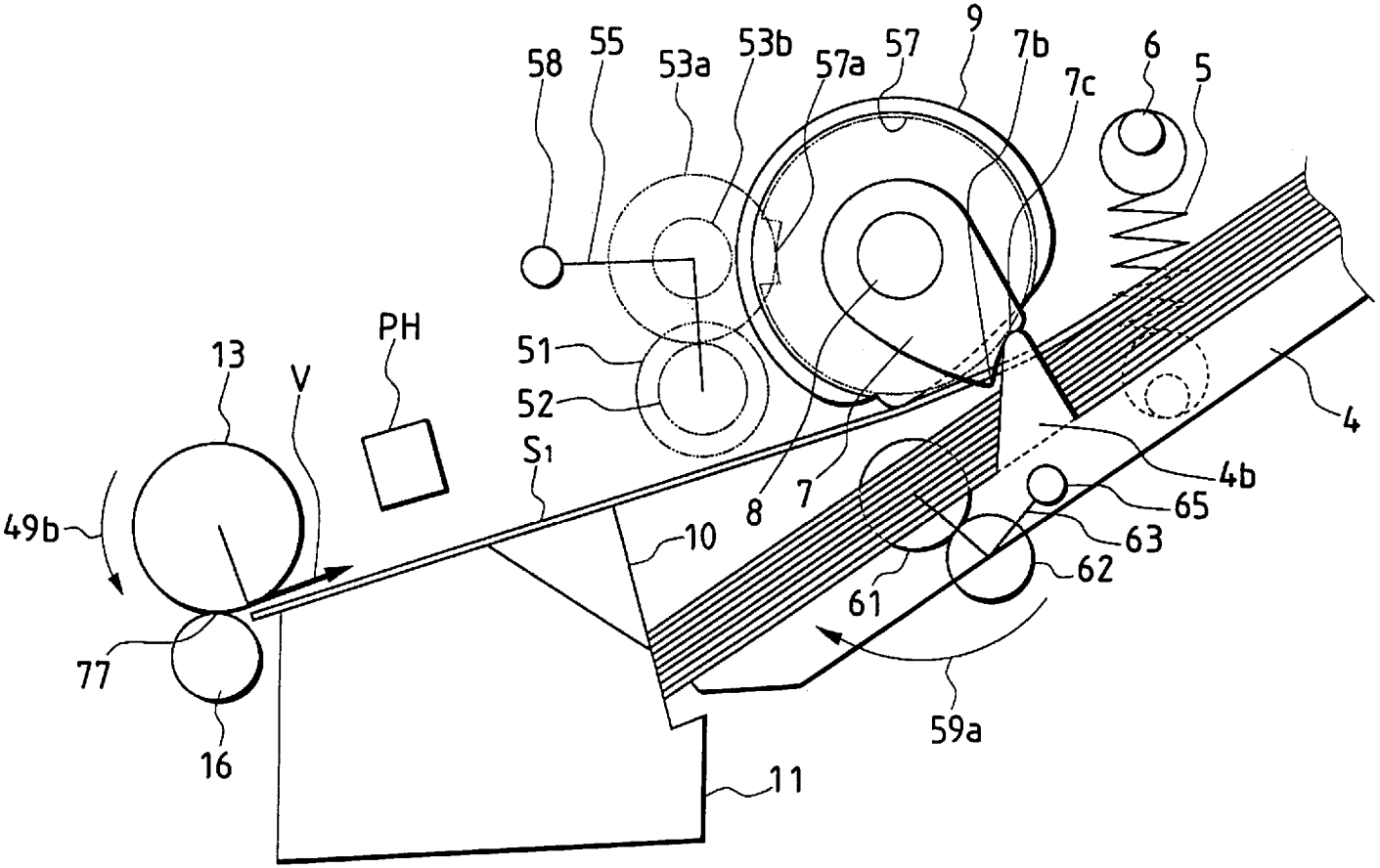
FIG. 10 is a side view of the sheet supply apparatus showing a condition that the sheet is conveyed in a reverse direction by the convey roller.

In FIG. 10, when the motor M is rotated in the reverse direction (shown by the arrow 47*b*) by the pulse number more than the pulse number $P_5$ to rotate the convey roller 13 in the direction shown by the arrow 49*b*, since the sheet $S_1$ is not pressurized by the sheet supply roller 9, the entire sheet $S_1$ is conveyed in the reverse direction so that the tip end of the sheet $S_1$ leaves the contact position 77 of the convey roller 13 toward the rearward direction and is stopped in the proximity of the contact position 77.

When the tip end of the sheet $S_1$ leaves the contact position 77, since the sheet $S_1$ is minutely shifted due to an inertia force generated by the reverse conveyance, the tip end of the sheet $S_1$ cannot abut against the contact position 77 sufficiently, with the result that the skew-feed of the sheet cannot be corrected completely. On the other hand, since the direction of the peripheral speed V of the convey roller 13 is substantially in parallel with the plane of the tip end portion of the sheet, the peripheral speed V acts to convey the sheet in the reverse direction, but, does not act to lift the tip end of the sheet. Thus, the tip end of the sheet $S_1$ is not lifted or not folded by the convey roller 13 which is being rotated in the reverse direction.

In the first embodiment, while an example that the sheet stacking plate 4 is separated from the sheet supply roller 9 by means of the mechanism for shifting the sheet stacking plate 4 with respect to the sheet supply roller 9 positioned at a fixed position was explained, a mechanism for shifting the sheet supply roller 9 with respect to the sheet stacking plate 4 positioned at a fixed position may be used. For example, the sheet supply roller 9 may be pivotable (liftable) so that the sheet supply roller 9 can be urged against the sheet stack at a predetermined timing by means of a solenoid, a cam and the like.

Further, when the motor M is further rotated from the condition of FIG. 10 in the direction shown by the arrow 47*b* to engage the second planetary gear 62 by the gear 57, the shaft 8 is rotated to rotate the cam members 7 and the sheet supply roller 9. When the cam members 7 are rotated, since the protruded portions 46*a* of the cam followers 4*b* are separated from the respective cam members 7, the sheet stacking plate 4 is lifted by the force of the springs 5 to urge the upper surface of the sheet $S_1$ against the sheet supply roller 9.

On the other hand, since the sheet supply roller 9 is rotated in the sheet supplying direction in response to the rotation of the shaft 8, the sheet $S_1$ is conveyed in the sheet supplying direction so that the tip end of the sheet $S_1$ is sufficiently urged against the contact position 77 of the convey roller 13 which is being rotated in the direction 49*b*, with the result that the skew-feed of the sheet $S_1$ is corrected. While the tip end of the sheet $S_1$ is being blocked by the convey roller 13 which is rotated in the reverse direction, the sheet supply roller 9 continues to be slipped on the surface of the sheet $S_1$.

Figure 11:
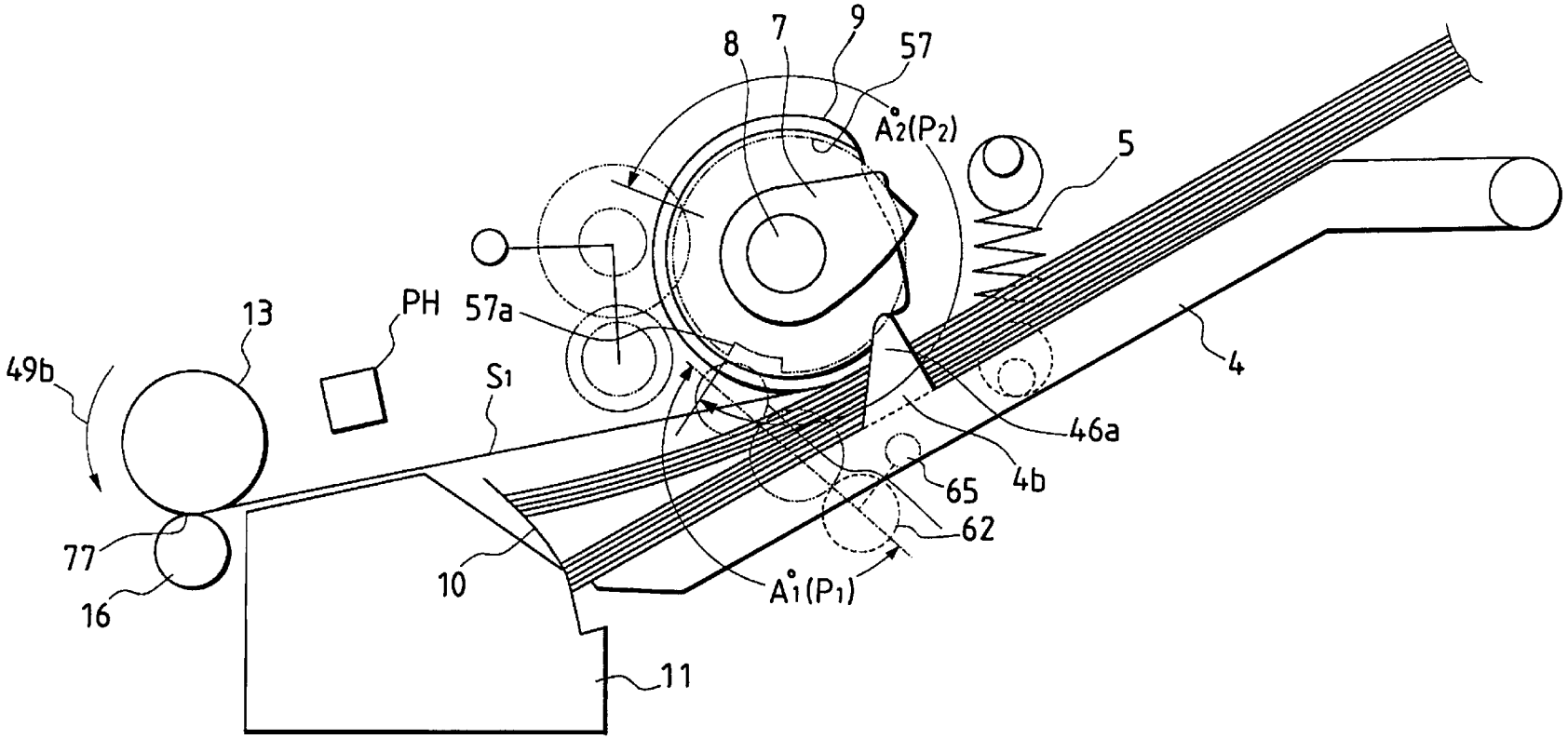
FIG. 11 is a side view of the sheet supply apparatus showing a condition that skew-feed of the sheet is being corrected by abutting the sheet against the convey roller which is now rotated in a reverse direction.

When the motor M is rotated in the direction 47*b* by the number $(P_1+P_2)$ of pulses which is the sum of the pulse number $P_1$ corresponding to the revolution angle $A_1°$ of the second planetary gear 62 and the pulse number $P_2$ corresponding to the rotation angle $A_2°$ of the sheet supply roller 9, as shown in FIG. 11, the non-toothed portion 57*a* of the gear 57 is opposed to the second planetary gear 62. As a result, the gear 57 is disengaged from the second planetary gear 62, thereby stopping the sheet supply roller 9.

Figure 12:
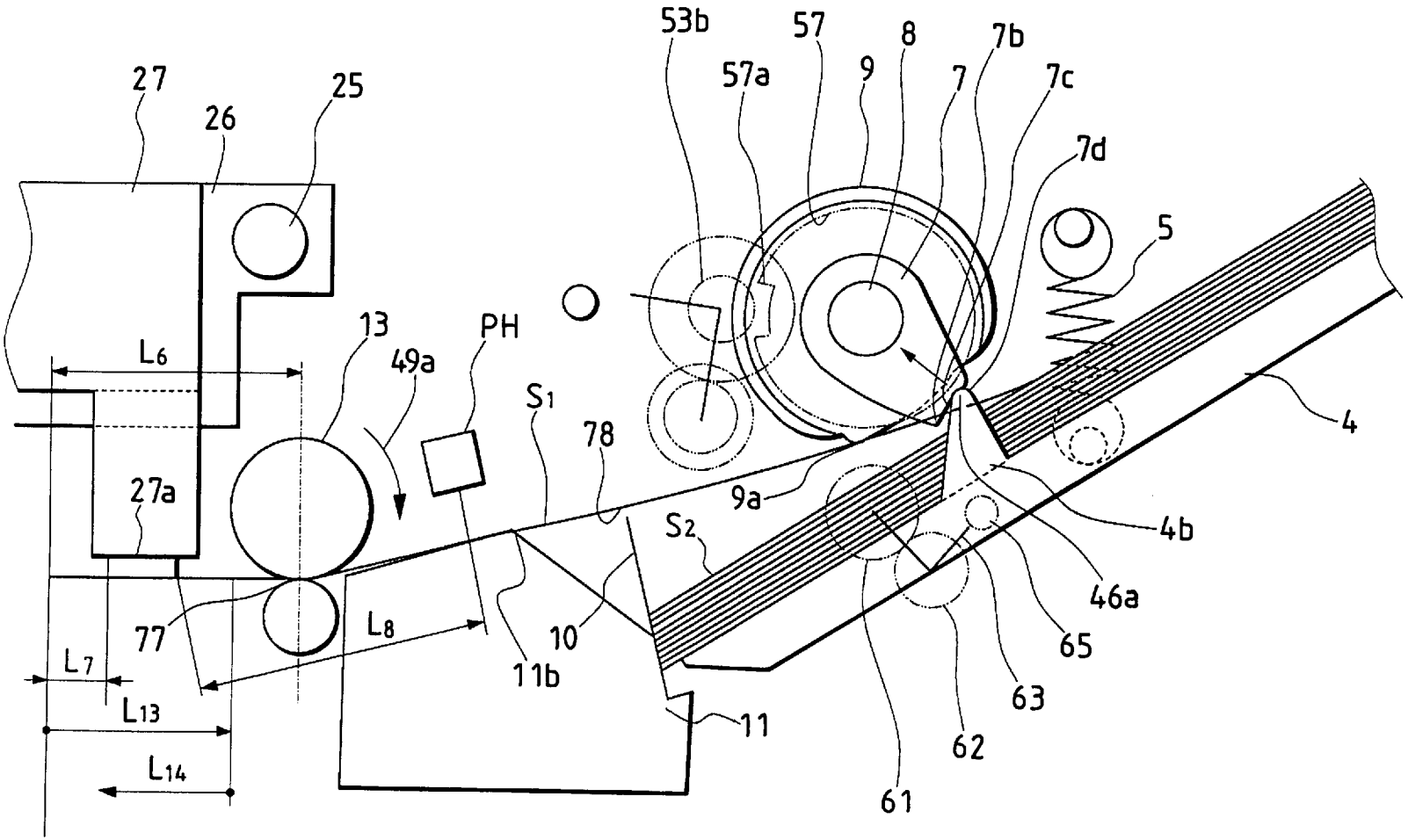
FIG. 12 is a side view of the sheet supply apparatus showing a condition that the sheet is being conveyed by rotating the sheet supply roller and the convey roller.

In FIGS. 11 and 12, when the motor M is rotated in the direction 47*a*, whereby the pulse number $P_4$ corresponds to the distance $L_6$, the convey roller 13 is rotated in the direction 49*a* and the sheet supply roller 9 is also rotated due to the engagement between the first planetary gear 53 and the gear 57, with the result that the tip end of the sheet $S_1$ is conveyed by the convey roller 13 to a position advancing from the contact position 77 by the distance $L_6$. When the tip end of the sheet $S_1$ passes through the contact position 77 of the convey roller 13, since the cam followers 4*b* are lowered by the cam members, the sheet stacking plate 4 is lowered in opposition to the force of the springs 5, with the result that the sheet $S_1$ is released from the pressure of the sheet supply roller 9.

The length or distance $L_6$ is set by the controller 34 so that a recording position of a foremost nozzle of the discharge portion 27*a* of the recording head 27 is spaced apart from the tip end of the sheet $S_1$ by a predetermined length or distance $L_7$. The operator can input the value of the length $L_7$ (for example, 1.5 mm, 3.0 mm or the like) to the controller 34 of the recording apparatus through a computer connected to the recording apparatus.

While the tip end of the sheet $S_1$ is being conveyed to the position corresponding to the length $L_6$ by means of the sheet supply roller 9 and the convey roller 13, the protruded portions 46*a* of the cam followers 4*b* must abut against stop position lift surfaces 7*a* of the drive cams 7. In FIG. 12, if unreliability of the abutment between the lift surfaces 7*a* and the protruded portions 46*a* is caused by increasing the length $L_7$, the conveyance of the length $L_7$ is achieved by first conveying the sheet by the sufficient greater length $L_6$ in the normal direction, then conveying the sheet by a predetermined length $L_{13}$ ($L_6>L_{13}$) in the reverse direction by the reverse rotation of the convey roller 13 and then conveying the sheet by a record position length $L_{14}$ in the normal direction by the normal rotation of the convey roller 13 (rotated in the direction 49*a*).

As mentioned above, in the above operation, the record position length $L_{14}$ can be freely changed while the length $L_6$ is fixed, with the result that the lift surfaces 7*a* can surely abut against the protruded portions 46*a*. Further, after the sheet is conveyed by the length $L_{13}$ in the reverse direction, by conveying the sheet by the length $L_{14}$ in the normal direction, the backlash of the gear means for transmitting the rotation of the motor M to the convey roller 13 can be eliminated, with the result that, after the conveyance of the length $L_{14}$, the fluctuation of the conveying accuracy of the recording conveyance of the sheet effected by the convey roller 13 can be minimized.

In FIGS. 1 and 12, while the carriage 27 is being reciprocally shifted in the main scan direction above the sheet $S_1$ conveyed to the recording position of the recording head 27, the ink is discharged from the discharge portion 27*a* of the recording head 27 under the control of the controller 34, thereby recording a predetermined image on the sheet $S_1$. After one-line recording is finished, the controller 34 controls the motor M to feed the sheet $S_1$ by one line space in the sub-scan direction.

By repeating the above-mentioned operations, the characters and/or images are recorded on the entire area of the sheet $S_1$ by the recording head 27.

When the sheet $S_1$ is conveyed by the convey roller 13 in the sub-scan direction, the sheet $S_1$ is regulated by flange portions 9*a* of the sheet supply roller 9 and the apex 11*b* of the guide member 11 to be shifted in a curved configuration. However, since the contact resistance between the guide member 11 and the sheet $S_1$ is small, a back load generated by the rotation of the convey roller 13 is very small. When the back load is very small, the fluctuation of the load acting on the motor M becomes little, and, thus, the conveying accuracy of the convey roller 13 is improved, with the result that the recording accuracy of the recording head 27 is also improved in thereby increasing the image quality.

In FIGS. 1, 2 and 12, when the trail end of the sheet $S_1$ is detected by the photo-sensor PH, the controller 34 estimates a length $L_8$ between the detection position of the photo-sensor PH and the rearmost nozzle of the ink discharge portion 27*a*, and, after the recording is effected by the recording head 27 within the length $L_8$, the convey roller 13 and the discharge rollers 20 are continuously rotated by a predetermined amount to discharge the sheet $S_1$ through the discharge opening 1*b*. After the discharge rollers 20 are continuously rotated by the predetermined amount, if the command from the computer is inputted to the controller 34, the latter performs the supply of the next sheet.

Incidentally, although a roller having a uniform diameter may be used as the sheet supply means, when the sheet supply roller 9 having the large diameter portion and the small diameter portion is used as is in the illustrated embodiment, the sheet is fed out by a high friction surface (rubber surface) of the rotating large diameter portion contacted with the sheet, and, after the sheet is supplied, the small diameter portion is opposed to the sheet stack. In the small diameter portion, since the flange portions 9*a* made of low friction material are protruded from the small diameter portion and the high friction surface is retarded, after the sheet is fed out, when the convey roller 13 starts to convey the sheet and the small diameter portion is opposed to the sheet stack, the flexed amount of the sheet is reduced by the difference in dimension between the large and small diameter portions, and, at the same time, the flange portions 9*a* contact with the sheet which is being conveyed, thereby preventing the sheet from floating. In this case, since the flange portions 9*a* are made of low friction material, resistance to the conveyance of the sheet is reduced, and, thus, the fluctuation of the load acting on the motor (drive source) M for the convey roller 13 is also reduced, thereby improving the conveying accuracy of the convey roller 13.

Next, a second embodiment of the present invention will be explained.

Figure 13:
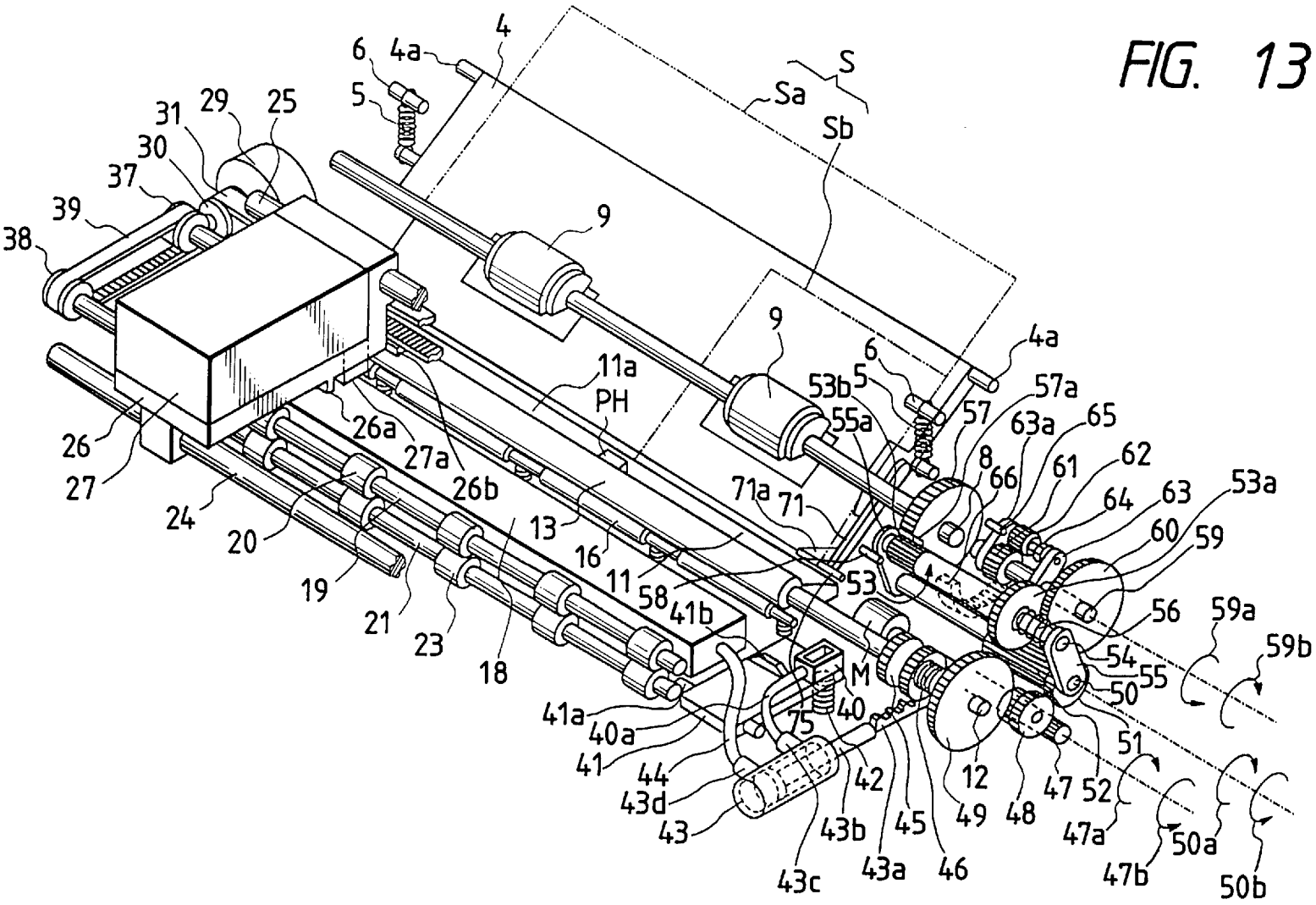
FIG. 13 is a perspective view of a recording apparatus having a sheet supply apparatus according to a second embodiment of the present invention.
Figure 14:
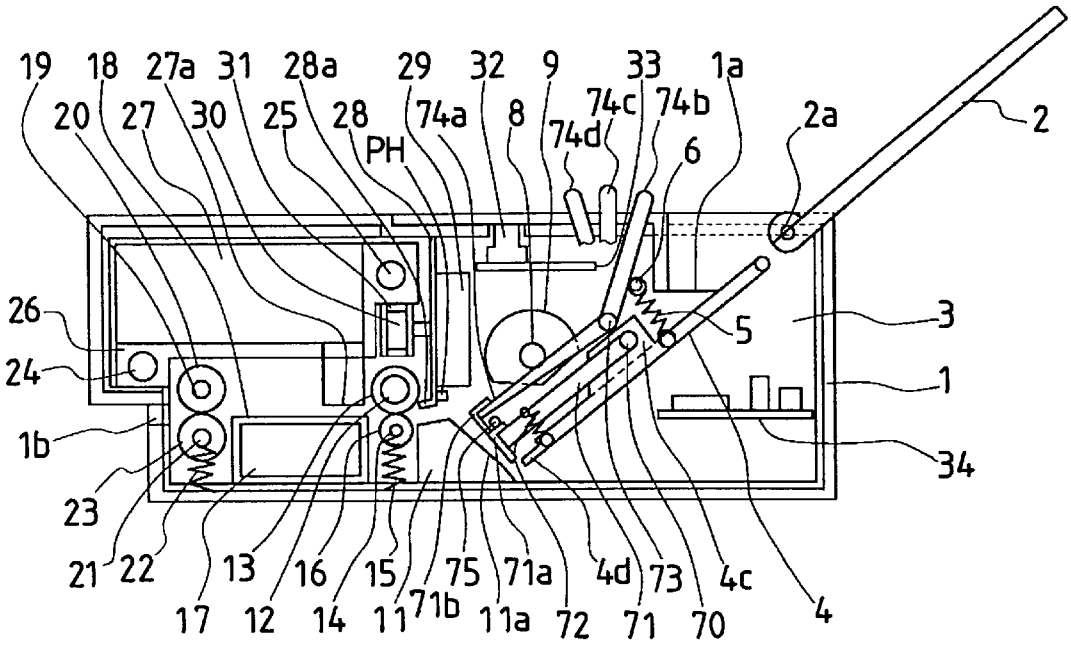
FIG. 14 is an elevational sectional view of the recording apparatus of FIG. 13.

FIGS. 13 and 14 show the second embodiment, where FIG. 13 is a perspective view of a recording apparatus having a sheet supply apparatus according to the second embodiment, and FIG. 14 is an elevational sectional view of the recording apparatus of FIG. 13. In FIGS. 13 and 14, elements having the same configuration and/or function as those shown in FIGS. 1 and 2 depicting the first embodiment are designated by the same reference numerals and a detailed explanation thereof will be omitted.

In the first embodiment, while an example that the sheets are separated one by one by using the abutment members each comprising the flexible thin plate against which the sheets abut so that both the thin sheets and thick sheets can be separated was explained, in the second embodiment, the thin sheets are separated one by one by using a corner separation pawl, and the thick sheets such as post cards, envelopes and the like are separated one by one by an inclined surface against which the sheets abut.

In FIG. 14, a pawl member 71 having a pawl portion 71*a* is pivotally mounted on a rotary shaft 70 supported by a side plate 4*c* disposed at one side of the sheet stacking plate 4 supported on the shaft 4*a*. The pawl member 71 is always biased toward the sheet stacking plate 4 by means of a spring 72. A switching lever 74 mounted on a shaft 73 serves to switch the pawl separation and the abutment separation and has a free end portion 74*a* engaged by a hook portion 71*b* of the pawl member 71. When the lever 74 is inclined to a clockwise position 74*b*, the sheet stacking plate 4 is lowered, and a distance between the pawl portion 71*a* and the sheet stacking plate 4 is increased so that the sheets can be inserted below the pawl portion 71*a*. The inserted sheets can be separated one by one by means of the pawl portion 71*a* at a position 74*c* of the lever 74 where the lowering of the sheet stacking plate 4 is released.

When the sheet stacking plate 4 on which the sheets were stacked is lifted under the action of the springs 5, a portion of the pawl member 71 which does not contribute to the separating action abuts against a fixed pin 75, thereby stopping the upward movement of the sheet stacking plate 4. In this stopped position, the small diameter portion of the sheet supply roller 9 is spaced apart from the sheet stack S and the large diameter portion of the sheet supply roller is contacted with the sheet stack S.

When the lever 74 is inclined to an anti-clockwise position 74*d*, the sheet stacking plate 4 is lowered, and the pawl portion 71*a* enters into a recess 4*d* formed in the end portion of the sheet stacking plate 4 under the action of the spring 72. Thus, the sheets S can be stacked on the pawl portion 71*a*. The sheets S stacked on the pawl portion 71*a* can be separated one by one by abutting the tip ends of the sheets S against the inclined surface 11*a* of the guide member 11 at the release position 74*c* where the lowering of the sheet stacking plate 4 is released.

The sheet supply roller 9 having the large and small diameter portions is secured to the shaft 8 and serves to supply the sheet toward the convey roller 13 by two rotational movements. The supplied sheet is pinched between the convey roller 13 and the main pinch roller 16 to be conveyed to the predetermined position. Since the other construction and elements are the same as those described in connection with FIG. 2, explanation thereof will be omitted.

Next, the sheet supplying operation and recording operation of the second embodiment will be explained with reference to FIGS. 13 to 21. FIGS. 15 to 21 are sectional views of main elements for supplying the sheet in FIG. 13.

First of all, as an initializing operation, when the power source of the recording apparatus is turned ON, in response to the initializing command from the controller 34 of FIG. 14, the motor M shown in FIG. 13 is rotated in the direction shown by the arrow 47*a*. When the convey roller 13 is rotated by the predetermined amount to convey the sheet S toward the discharge opening 1*b* shown in FIG. 14, in the driving force transmitting portion, the rotational force of FIG. 5 is not transmitted to the sheet supply roller 9, and the sheet supply portion is in a condition shown in FIG. 14.

Figure 15:
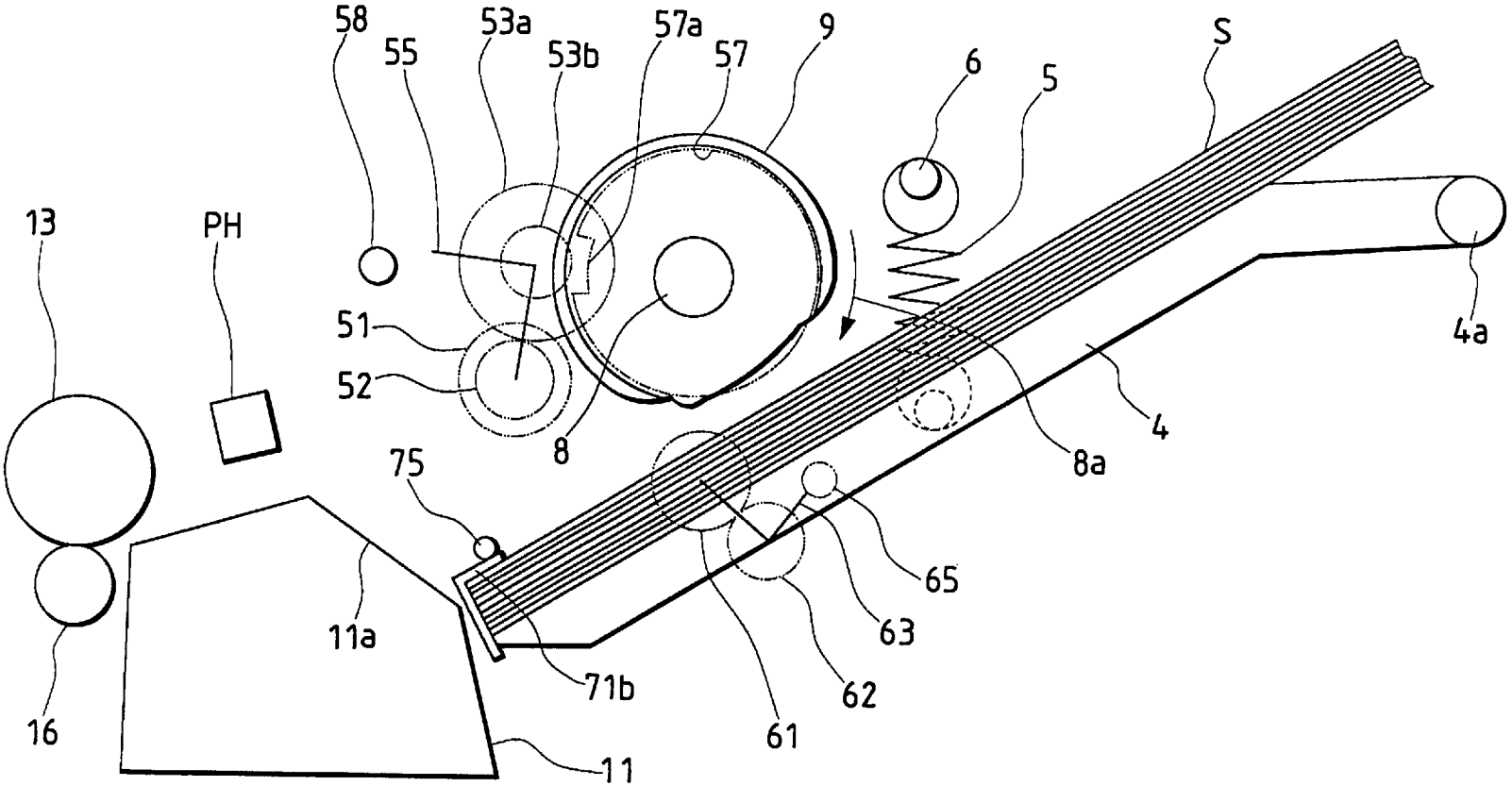
FIGS. 15 and 16 are side views of the sheet supply apparatus of FIG. 13 showing a condition that sheets are not yet separated.

In the condition shown in FIG. 14, the tip ends of the sheets S stacked on the sheet stacking plate 4 are urged against the pawl portion 71*a* below the latter. Then, when the lever 74 is switched from the position 74*b* to the position 74*c*, a condition shown in FIG. 15 is attained. In FIG. 15, the sheet stacking plate 4 on which the sheets S were stacked and which are lifted under the action of the spring 5 is stopped when the pawl portion 71*b* abuts against the pin 75. In this condition, the upper surface of the sheet stack S positioned below the pawl portion 71*b* is spaced apart from the small diameter portion of the sheet supply roller 9.

Figure 16:
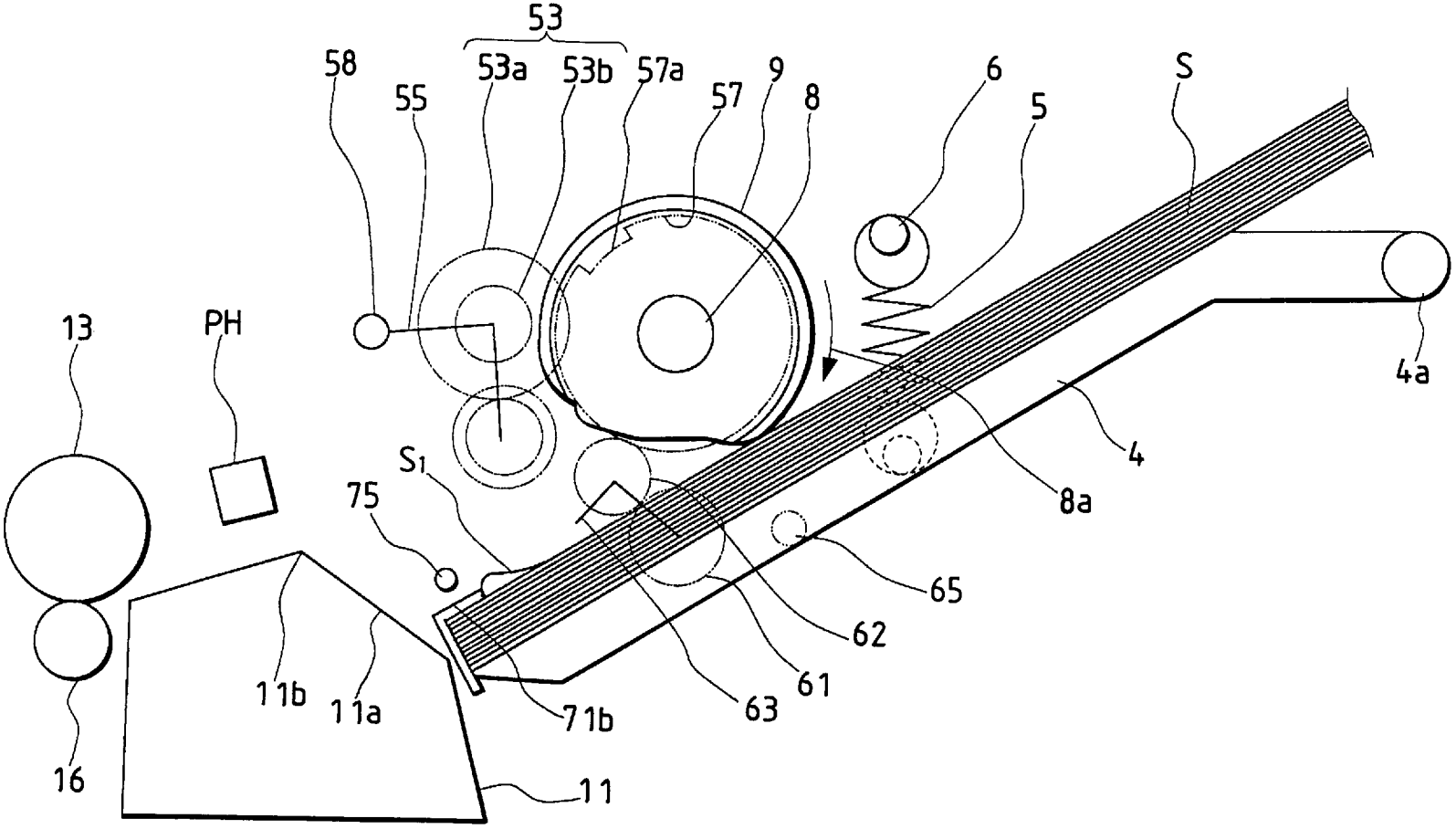

In FIGS. 4 and 16, when the motor M is rotated in the direction 47*b* by the predetermined amount in response to the sheet supply command from the controller 34, the second planetary gear 62 is revolved from the position where the second carrier 63 is engaged by the pin 65 to the engage position where the second planetary gear 62 is engaged by the gear 57. Since the second planetary gear 62 brought to the engage position can transmit the rotational force of the motor M in the direction 47*b* to the gear 57, the sheet supply roller 9 starts to rotate in the direction 8*a*, i.e., sheet supplying direction via the shaft 8. When the sheet supply roller 9 is rotated, the large diameter portion of the sheet supply roller 9 having the high friction surface abuts against the uppermost sheet $S_1$ of the sheet stack S while lowering the sheet stacking plate 4 in opposition to the force of the springs 5 via the sheet stack S. In this condition, the pawl portion 71*b* is separated from the pin 75, the urging force required for supplying the sheet is generated by the springs 5 between the sheet $S_1$ and the sheet supply roller 9.

On the other hand, due to the rotation of the sheet supply roller 9, the sheet $S_1$ is shifted in the sheet supplying direction. By this shifting movement, a small loop is formed in a front corner of the sheet $S_1$ blocked by the pawl portion 71*b*. When the sheet is further shifted, the looped front corner of the sheet rides over the pawl portion 71*b*, thereby separating the sheet $S_1$ from the other sheets.

Figure 17:
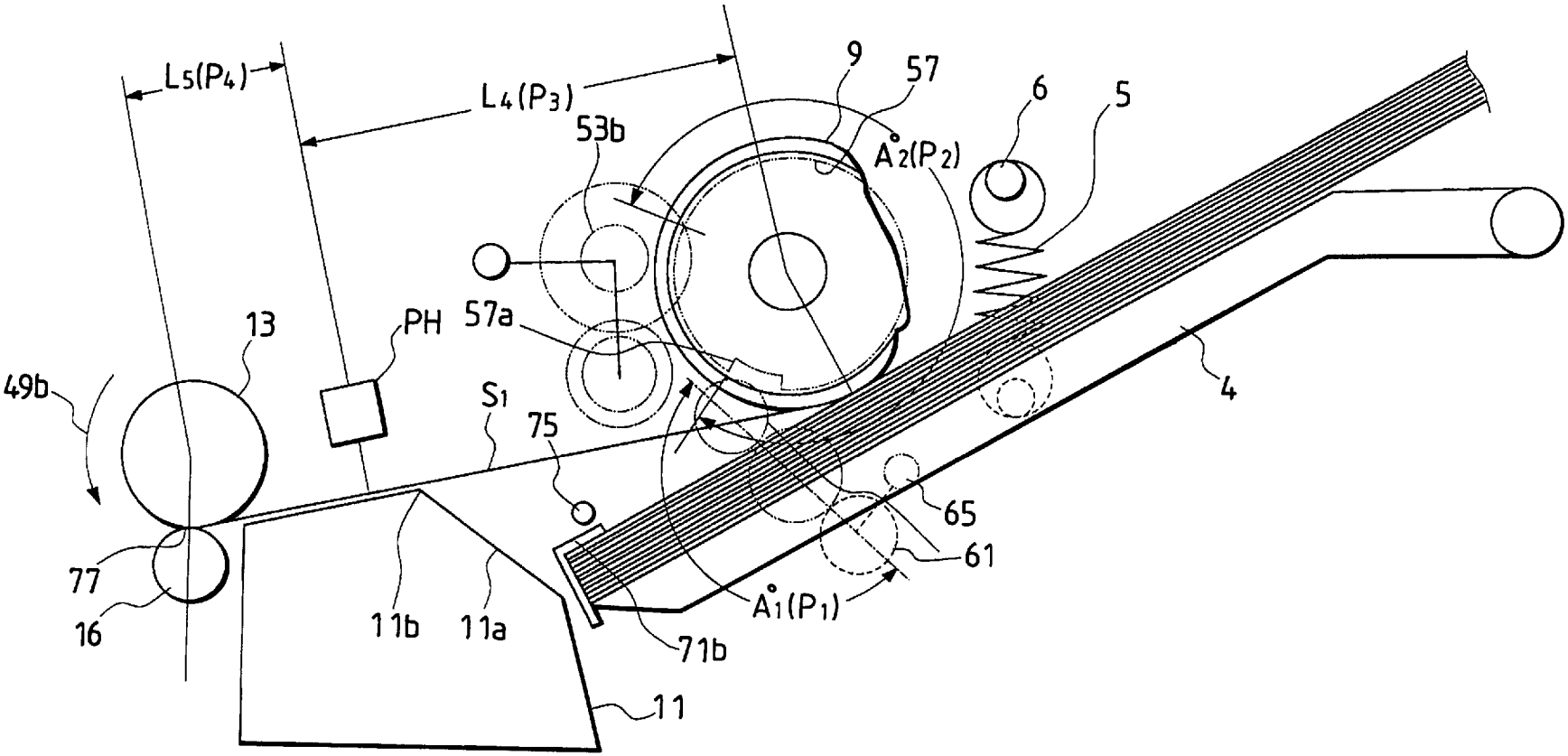
FIG. 17 is a side view of the sheet supply apparatus of FIG. 13 showing a feed amount of sheets obtained by a sheet supply roller.

In FIG. 17, the tip end of the sheet $S_1$ which rides over the pawl portion is lifted upwardly by the inclined surface 11*a* of the guide member 11. Then, the tip end of the sheet $S_1$ exceeds the apex 11*b* of the guide member 11 and moves toward the contact position 77 between the convey roller 13 and the first pinch roller 16. When the tip end of the separated sheet passes through the photo-sensor PH, the signal is generated from the photo-sensor PH. In response to this signal, under the control of the controller 34 of FIG. 2, the motor M is rotated by the number $P_4$ of pulses corresponding to the distance $L_5$ and then is temporarily stopped. Since the sheet supply roller 9 is rotated in response to the rotation of motor M for the pulse number $P_4$, the tip end of the sheet $S_1$ is supplied near the contact position 77 between the first pinch roller 16 and the convey roller 13 which is now rotated reversely in the direction 49*b*. In this condition, since the non-toothed portion 57*a* of the gear 57 is opposed to the second planetary gear 62, the transmission of the force from the motor to the sheet supply roller is interrupted, thereby stopping the sheet supply roller 9 temporarily.

Figure 18:
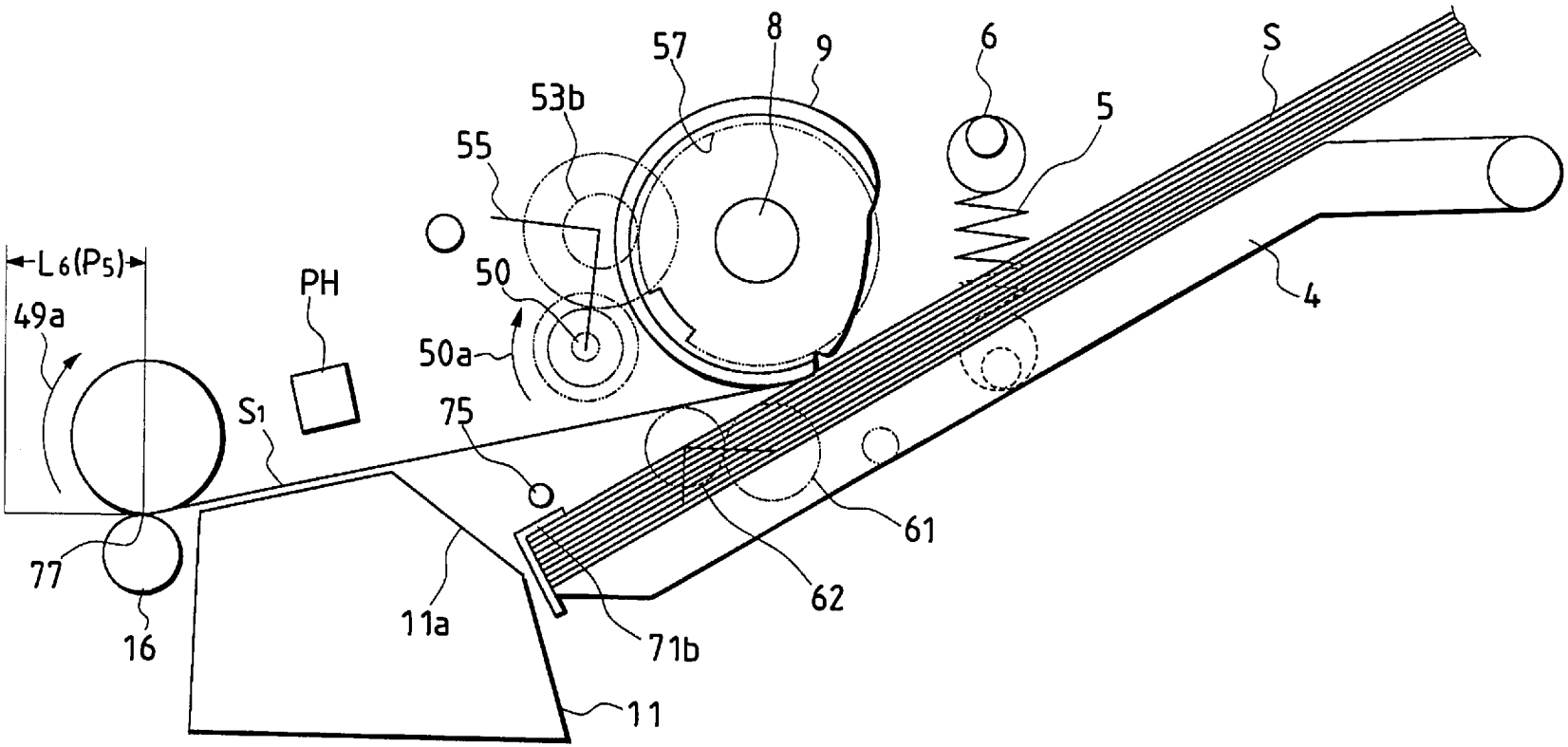
FIG. 18 is a side view of the sheet supply apparatus of FIG. 13 showing a condition that the sheets are conveyed by a predetermined amount by means of a convey roller.

In FIG. 18, after the motor is rotated by the number $P_4$ of pulses, when the motor M is rotated in the normal direction shown by the arrow 47*a* by the number $P_5$ of pulses corresponding to the distance $L_6$ through which the sheet is conveyed by the convey roller 13 (i.e., the condition shown in FIG. 4 is changed to the condition shown in FIG. 3), the first planetary gear 53 is engaged by the gear 57. When the motor M is rotated by the number $P_5$ of pulses, the sheet supply roller 9 is further rotated to enter the tip end of the sheet $S_1$ into the contact position 77, with the result that the tip end of the sheet $S_1$ is conveyed by the distance $L_6$ by the rotation of the convey roller 13 in the direction 49*a*.

Figure 19:
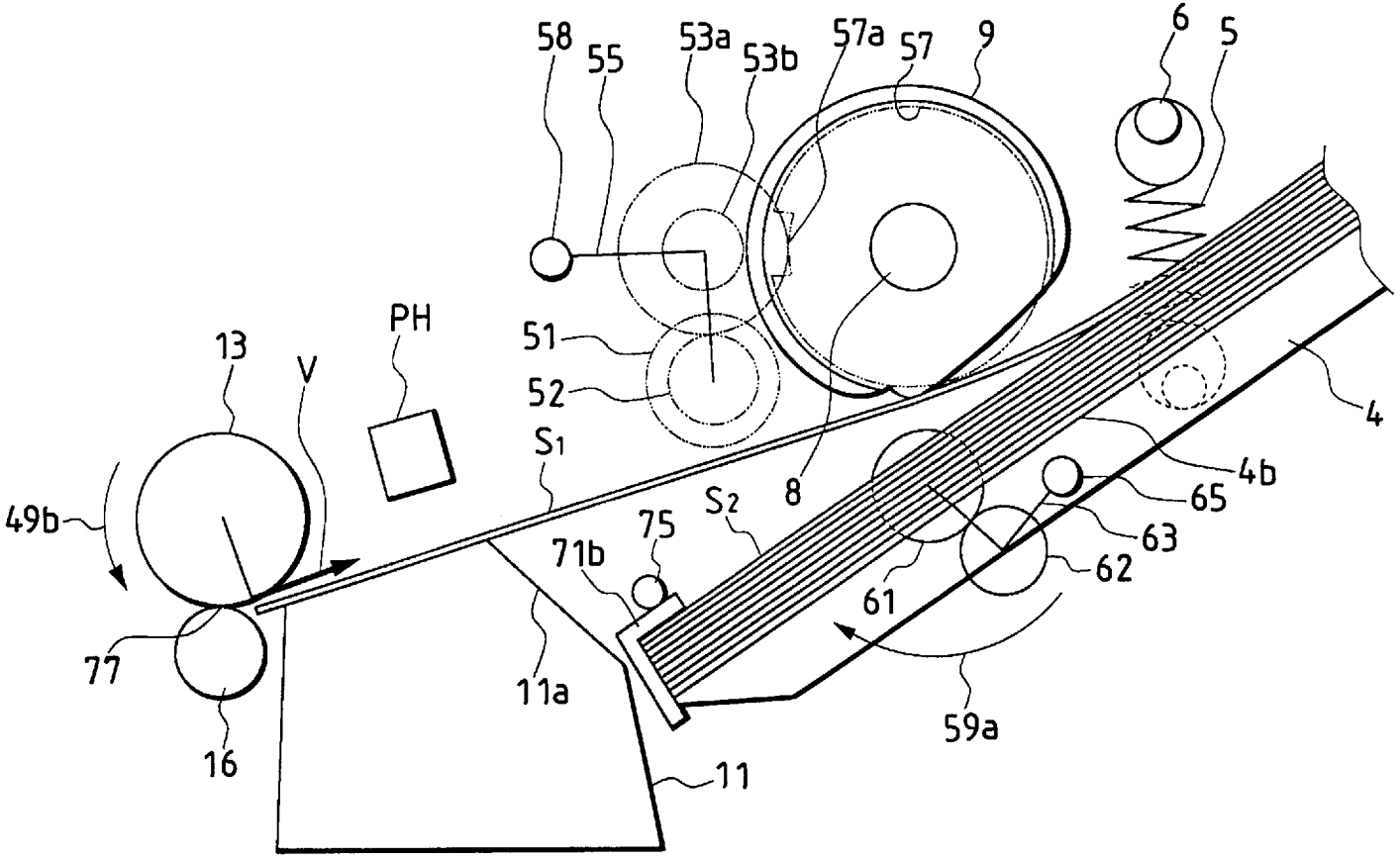
FIG. 19 is a side view of the sheet supply apparatus of FIG. 13 showing a condition that the sheet is conveyed in a reverse direction by a convey roller.

In FIGS. 18 and 19, during the rotation of the motor M by the pulse number $P_5$, when the non-toothed portion 57*b* of the gear 47 is opposed to the first planetary gear 53, the first planetary gear 53 is rotated idly not to transmit the rotational force to the gear 57, with the result that the sheet supply roller 9 is stopped with the small diameter portion opposed to the sheet stack $S_1$. When the small diameter portion of the sheet supply roller 9 is opposed to the sheet stack $S_1$, since the pawl portion 71*b* provided on the sheet stacking plate 4 is urged against the pin 75 by the springs 5, the upward movement of the sheet stacking plate 4 is stopped. As a result, the sheet stack $S_2$ positioned under the pawl portion 71*b* is separated from the sheet supply roller 9.

In FIG. 19, when the motor M is rotated in the reverse direction (shown by the arrow 47*b*) by the pulse number more than the pulse number $P_4$ to rotate the convey roller 13 in the direction shown by the arrow 49*b*, since the sheet $S_1$ is not pressurized by the sheet supply roller 9, the entire sheet $S_1$ is conveyed in the reverse direction so that the tip end of the sheet $S_1$ leaves the contact position 77 of the convey roller 13 toward the rearward direction and is stopped in the proximity of the contact position 77. In this condition, since the direction of the peripheral speed V of the convey roller 13 is substantially in parallel with the plane of the tip end portion of the sheet, the tip end of the sheet $S_1$ is not lifted or not folded by the convey roller 13 which is being rotated in the reverse direction.

When the motor M is further rotated in the direction 47*b*, the second planetary gear 62 is engaged by the gear 57, thereby rotating the sheet supply roller 9 via the shaft 8. By the rotation of the sheet supply roller 9, the sheet $S_1$ is conveyed in the sheet supplying direction so that the tip end of the sheet $S_1$ is sufficiently urged against the contact position 77 of the convey roller 13 which is being rotated in the direction 49*b*, with the result that the skew-feed of the sheet $S_1$ is corrected. While the tip end of the sheet $S_1$ is being blocked by the convey roller 13 which is rotated in the reverse direction, the sheet supply roller 9 continues to slip on the surface of the sheet $S_1$.

Figure 20:
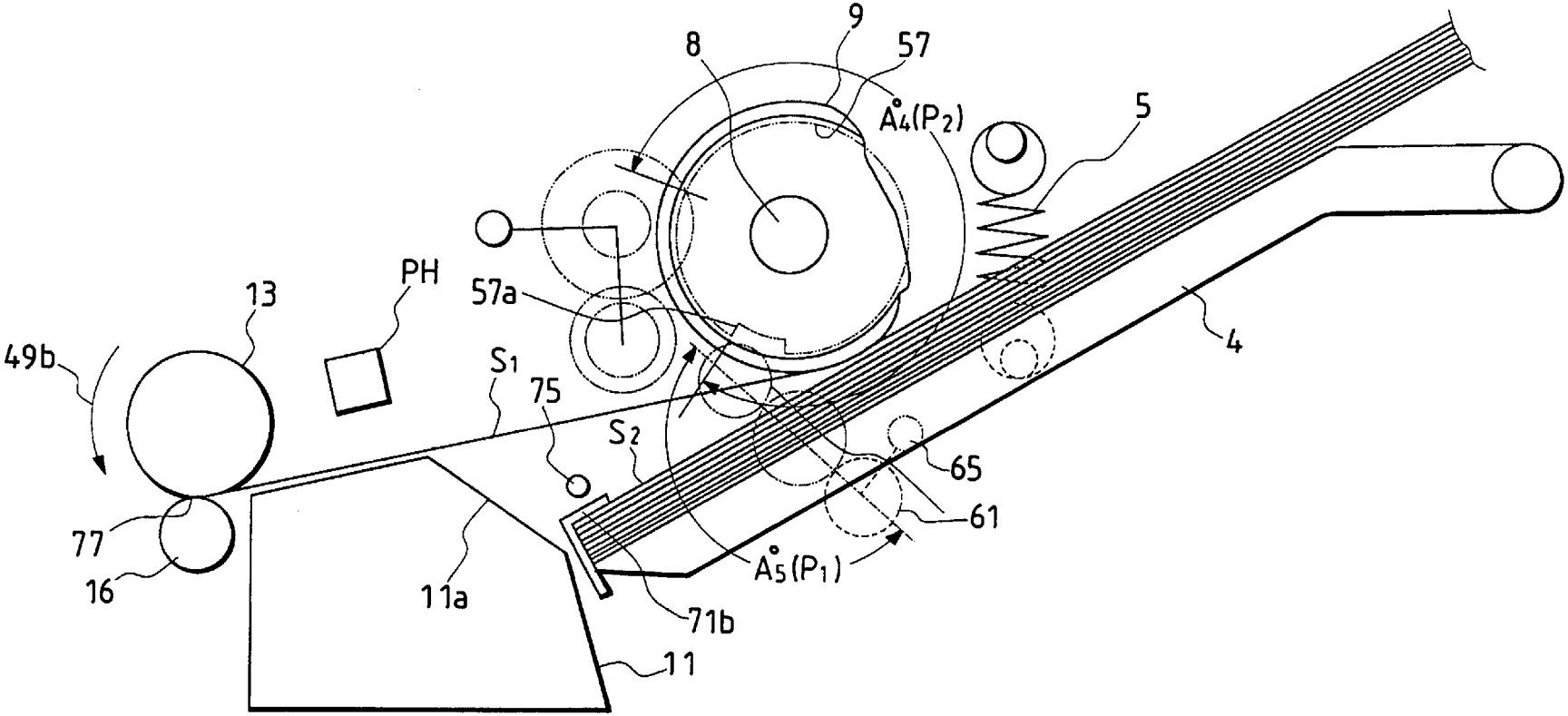
FIG. 20 is a side view of the sheet supply apparatus of FIG. 13 showing a condition that skew-feed of the sheet is being corrected by abutting the sheet against the convey roller which is now rotated in a reverse direction.

When the motor M is rotated in the direction 47*b* by the number $(P_1+P_2)$ of pulses, as shown in FIG. 20, the non-toothed portion 57*a* of the gear 57 is opposed to the second planetary gear 62. As a result, the gear 57 is disengaged from the second planetary gear 62, thereby stopping the sheet supply roller 9 temporarily.

Figure 21:
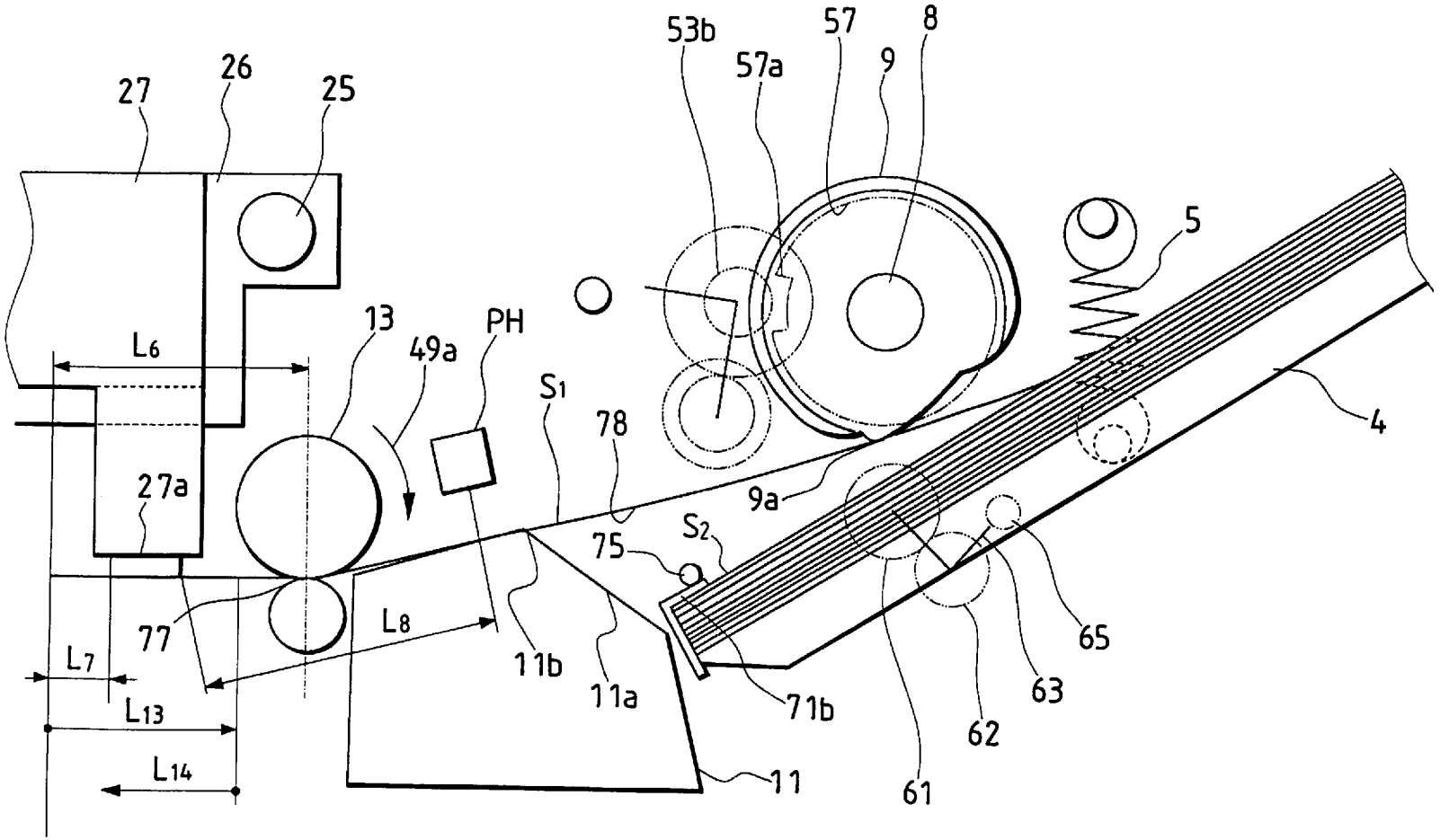
FIG. 21 is a side view of the sheet supply apparatus of FIG. 13 showing a condition that the sheet is being conveyed by rotating the sheet supply roller and the convey roller.

In FIG. 21, when the motor M is rotated in the direction 47*a* by the pulse number $P_4$ corresponding to the distance $L_6$, the convey roller 13 is rotated in the direction 49*a* and the sheet supply roller 9 is also rotated due to the engagement between the first planetary gear 53 and the gear 57, with the result that the tip end of the sheet $S_1$ is conveyed by the convey roller 13 to a position advancing from the contact position 77 by the distance $L_6$. The length or distance $L_6$ is set by the controller 34 so that a recording position of a foremost nozzle of the discharge portion 27*a* of the recording head 27 is spaced apart from the tip end of the sheet $S_1$ by a predetermined length or distance $L_7$.

During the rotation of the motor M by the pulse number $P_4$ corresponding to the length $L_6$, when the non-toothed portion 57*b* of the gear 47 is opposed to the first planetary gear 53, the first planetary gear 53 is rotated idly not to transmit the rotational force to the gear 57, with the result that the sheet supply roller 9 is stopped with the small diameter portion opposed to the sheet stack $S_1$.

In this condition, since the sheet $S_1$ is not pressurized by the sheet supply roller 9, a back load acting on the sheet $S_1$ is reduced and the fluctuation of the load acting on the motor M when the sheet is conveyed by the convey roller for recording becomes little, and, thus, the conveying accuracy of the convey roller 13 is improved, with the result that the recording accuracy of the recording head 27 is also improved, thereby increasing the image quality.

In FIGS. 13 and 21, while the carriage 27 is being reciprocally shifted in the main scan direction above the sheet $S_1$ conveyed to the recording position of the recording head 27, the ink is discharged from the discharge portion 27*a* of the recording head 27 under the control of the controller 34, thereby recording a predetermined image on the sheet $S_1$. After one-line recording is finished, the controller 34 controls the motor M to feed the sheet $S_1$ by one line space in the sub-scan direction. By repeating the above-mentioned operations, the characters and/or images are recorded on the entire area of the sheet $S_1$ by the recording head 27.

In FIGS. 13, 14 and 21, when the trail end of the sheet $S_1$ is detected by the photo-sensor PH, the controller 34 estimates the length $L_8$ between the detection position of the photo-sensor PH and the rearmost nozzle of the ink discharge portion 27*a*, and, after the recording is effected by the recording head 27 within the length $L_8$, the convey roller 13 and the discharge rollers 20 are continuously rotated by a predetermined amount to discharge the sheet $S_1$ through the discharge opening 1*b*. After the discharge rollers 20 are continuously rotated by the predetermined amount, if the command from the computer connected to the recording apparatus is inputted to the controller 34, the latter performs the supply of the next sheet.

Figure 22:
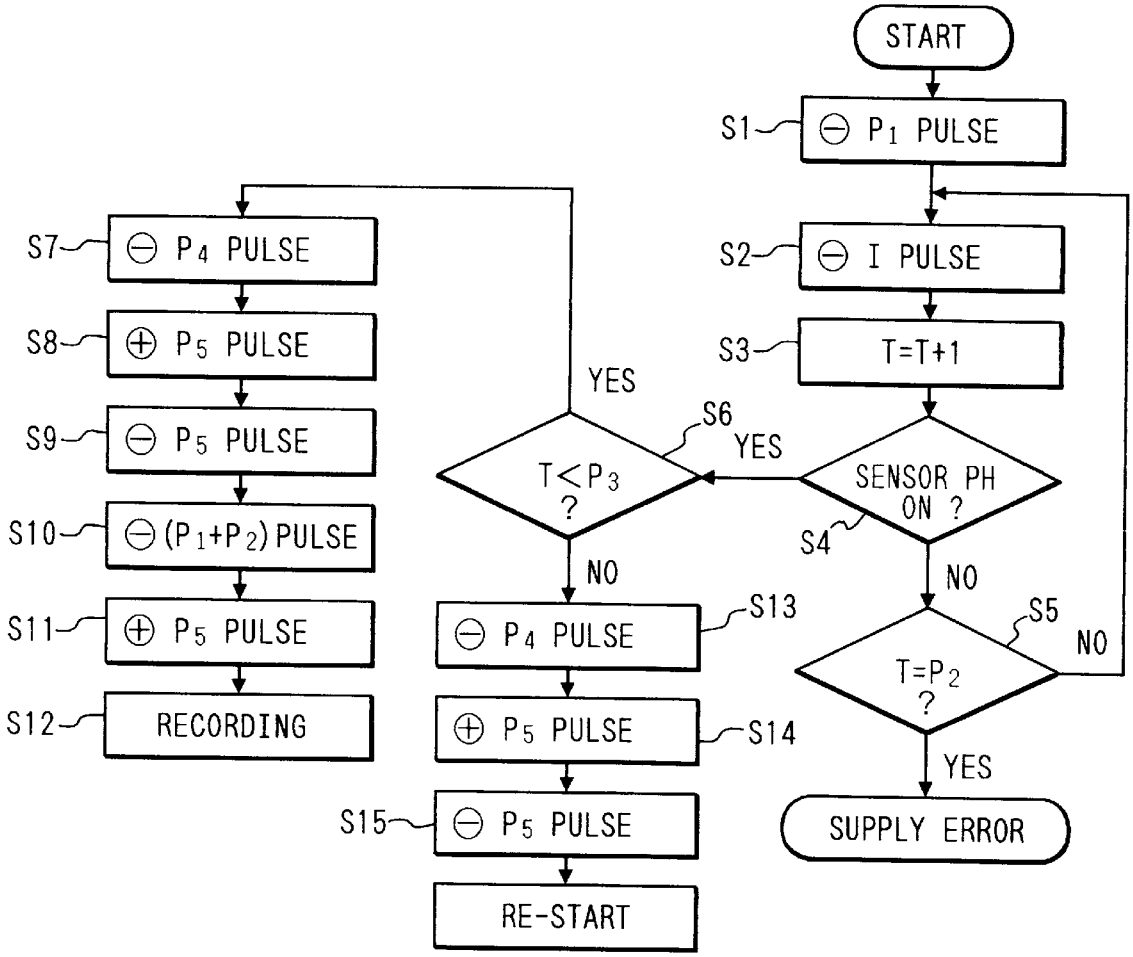
FIG. 22 is a flow chart for explaining control of the sheet supply apparatus according to the present invention.

Next, a procedure for manipulating the motor M in the first and second embodiments will be explained with reference to FIGS. 7, 17 and 22. FIG. 22 is a flow chart showing the operation of the sheet supply apparatus. In FIG. 22, a circled symbol+(plus) indicates the normal rotation (to the direction 47*a*) of the motor M, and a circled symbol−(minus) indicates the reverse rotation (to the direction 47*b*) of the motor M. Incidentally, the motor M (FIGS. 1 and 13) acting as the drive source for the sheet supply rollers 9 and the convey roller 13 comprises a pulse drive motor.

In FIGS. 7, 17 and 22, in various steps, the numbers of pulses applied to the motor M are as follows:

$P_1$=number of pulses required for revolving the second planetary gear 62 by an angle $A_1$°;

$P_2$=number of pulses corresponding to an angle $A_2$° through which the non-toothed portion of the gear 57 is rotated from the position where it is opposed to the first planetary gear 53 to the position where it is opposed to the second planetary gear 62;

$P_3$=number of pulses corresponding to the rotation of the sheet supply roller 9 by the distance $L_4$;

$P_4$=number of pulses corresponding to the rotation of the sheet supply roller 9 by the distance $L_5$; and $P_5$=number of pulses corresponding to the rotation of the convey roller 13 by a distance $L_6$.

In FIG. 22, the motor M starts to rotate at the "start" for the pulse number $P_1$. In a step S1, when the second planetary gear 62 is engaged by the gear 57, the motor M is stopped. Then, in a loop between a step S2 and a step S5, the motor M is rotated in the reverse direction until a count value T of a counter in a step S3 reaches a value $P_2$. During the reverse rotation of the motor M, when the photo-sensor PH is turned ON in a step S4, the count value T is checked in a step S6. In the step S6, if $T<P_3$, the sequence goes to a step S7, where the tip end of the sheet $S_1$ is conveyed up to the contact position 77 between the reversely rotating convey roller 13 and the first pinch rollers 16.

Then, in a step S8, the motor M is rotated by the pulse number $P_5$ in the normal direction to convey the tip end of the sheet $S_1$ from the convey roller 13 by the distance $L_6$. Then, in a step S9, by the reverse rotation of the motor M by the pulse number $P_5$, since the convey roller 13 is rotated in the reverse direction, the tip end of the sheet $S_1$ is returned to the vicinity of the contact position 77.

Then, in a step S10, by the reverse rotation of the motor M by the pulse number $(P_1+P_2)$, since the sheet $S_1$ is shifted by the rotation of the sheet supply roller 9, the tip end of the sheet $S_1$ is urged against the contact position 77 of the convey roller 13 which is now reversely rotated, thereby correcting the skew-feed of the sheet $S_1$.

Next, in a step S11, the motor M is rotated by the pulse number $P_5$ in the normal direction, so that the tip end of the sheet $S_1$ is conveyed to the predetermined record position $L_6$. Then, by the recording in a step S12, an image is recorded on the sheet $S_1$. In the step S6, it is judged as $T>P_3$, even when the operation of the step S7 is effected, the tip end of the sheet $S_1$ does not often reach the nip 77.

That is to say, when $P_2=(P_3+P_4)$, if $T>P_3$, since the non-toothed portion 57*a* of the gear 57 is opposed to the second planetary gear 62 as shown in FIG. 4 during the rotation of the motor M by the pulse number $P_4$, the sheet supply roller 9 is stopped so that the sheet supply roller 9 cannot convey the sheet by an amount smaller than the pulse number $P_4$. Such a phenomenon will occur when the sheet supplying force of the sheet supply roller is reduced due to the low coefficient $\mu$ of friction of the sheet so that the sheet supply roller supplies the sheet while slipping on the sheet.

In the step S6, if it is judged as $T>P_3$, steps S13 and S14 are effected so that the non-toothed portion 57*a* of the gear 57 is brought to the first planetary gear 53, with the result that, the sheet supply roller 9 is stopped after it is rotated by one revolution and the tip end of the sheet is once pinched between the convey roller 13 and the pinch roller 16. Thereafter, in a step S15, when the convey roller 13 is rotated in the reverse direction by the amount corresponding to the pulse number $P_5$, the sheet $S_1$ is returned toward the sheet supply roller so that the tip end of the sheet $S_1$ is positioned near the contact position 77. After the step S15 is effected, the sequence directly goes to the step S1. In this case, since the photo-sensor PH was already turned ON by the sheet $S_1$, the sequence goes from the step S4 to the step S6. In the step S6, since $T<P_3$, the sequence goes to the step S7 and goes to the step S12 through the steps S8 to S11. In the step S12, the normal recording operation is performed.

Even when $T=P_2$ in the step S5, if the photo-sensor is not turned ON in the step S4, it is judged that the sheet is jammed at an upstream side of the photo-sensor PH, and the control mode is changed to a sheet supply error mode by the controller 34.

The controller 34 displays the sheet supply error by using an LED display means or liquid crystal display means provided on the operation electric substrate 33 of FIG. 2 and informs the operator of the error by a buzzer or an alarm. The operator can retract the sheet on the sheet stacking plate 4 on the basis of the error display, and ascertain whether the tip end(s) of the sheet(s) is bent or folded. After the sheets are correctly rested on the sheet stacking plate 4 again, the sheet supplying operation is re-started.

Next, a third embodiment of the present invention will be explained.

Now, an example that the present invention is applied to re-start (re-tray) control regarding a delay in conveyance of the sheet will be described with reference to FIGS. 23 and 24.

In this embodiment, the correction of the skew-feed of the sheet is effected by abutting the tip end of the sheet against the nip of the convey roller which is rotating in the reverse direction, and the present invention is applied only to the re-start control.

Incidentally, since the fundamental construction of the sheet supply apparatus according to the third embodiment is the same as those in the previous embodiments, a detailed explanation thereof will be omitted.

Figure 23:
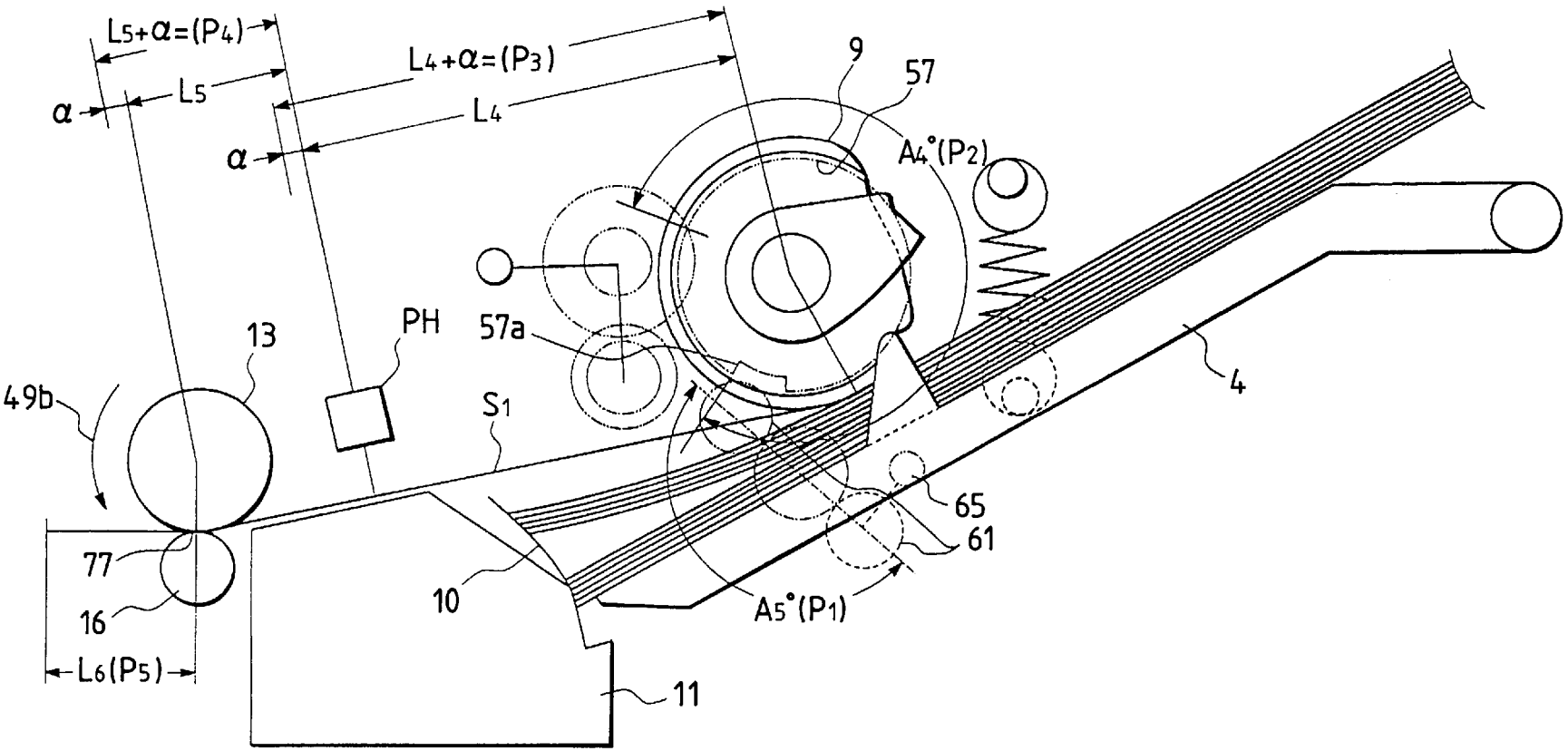
FIG. 23 is a side view of a sheet supply apparatus according to a third embodiment of the present invention.

In FIG. 23, when the tip end of the separated sheet passes through the photo-sensor PH, a signal is generated from the photo-sensor PH. On the basis of this signal, under the control of the controller 34 of FIG. 2, the motor M is rotated by the pulse number $P_4$ corresponding to a distance $L_5+\alpha$ ($\alpha$=play value=2–5 mm) and is stopped temporarily. By the rotation of the sheet supply roller 9 in response to the rotation of the motor M by the pulse number $P_4$, the tip end of the sheet $S_1$ is urged against the contact position 77 between the first pinch roller 16 and the convey roller 13 which is being rotated in the reverse direction, thereby preventing the further shifting movement of the tip end of the sheet $S_1$. In this condition, if the sheet supply roller 9 is still rotating, the sheet supply 9 will be rotated while being slipped on the sheet $S_1$.

If the sheet $S_1$ is skew-fed, although one corner of the tip end of the sheet first abuts against the contact position 77 and is stopped, since the other corner of the tip end is still shifted, the sheet will be rotated or turned around said one corner. As a result, the tip end of the sheet is aligned with the contact position along its whole length, thereby correcting the skew-feed of the sheet.

After the motor is rotated by the pulse number $P_4$, the motor M is rotated in the normal direction by the pulse number $P_5$ corresponding to the distance $L_6$ through which the sheet is conveyed by the convey roller 13 (i.e., the condition shown in FIG. 4 is changed to the condition shown in FIG. 3). When the motor M is rotated by the pulse number $P_5$, the sheet supply roller 9 is further rotated to enter the tip end of the sheet $S_1$ into the contact position 77, with the result that the tip end of the sheet $S_1$ is conveyed by the distance $L_6$ by the rotation of the convey roller 13 in the direction opposite to the direction shown by the arrow 49*b*.

Now, a correction means for correcting a poor sheet supply or poor heading of the record position will be explained with reference to FIGS. 23 and 24. FIG. 24 is a flow chart showing the operation of the sheet supply apparatus. In FIG. 24, a circled symbol + (plus) indicates the normal rotation (to the direction 47*a*) of the motor M, and a circled symbol –(minus) indicates the reverse rotation (to the direction 47*b*) of the motor M. Incidentally, the motor M (FIG. 1) acting as the drive source for the sheet supply rollers 9 and the convey roller 13 comprises a pulse drive motor.

Figure 24:
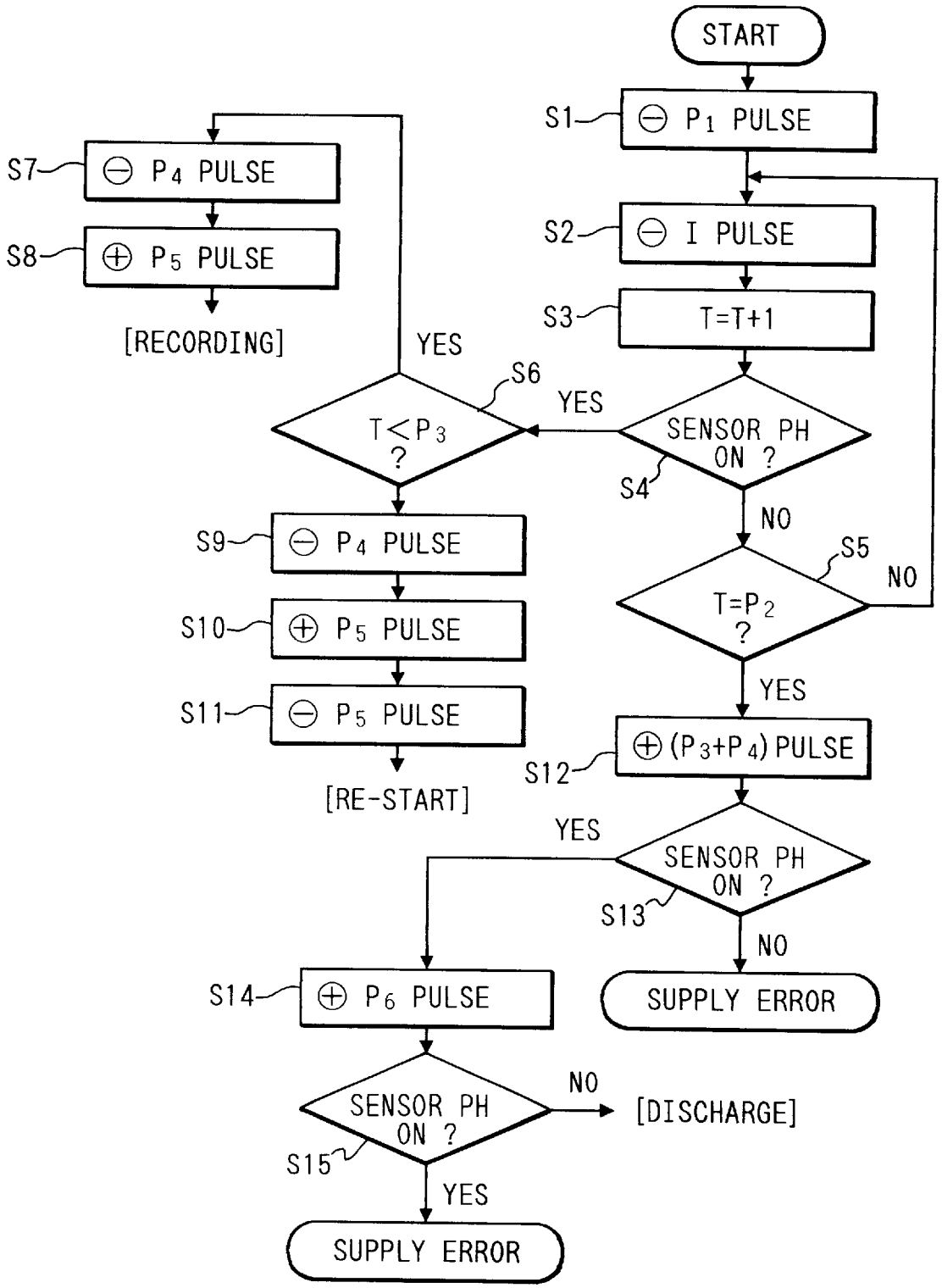
FIG. 24 is a flow chart for explaining control of the sheet supply apparatus of FIG. 23.

In FIGS. 23 and 24, in various steps, the numbers of pulses applied to the motor M are as follows:

$P_1$=number of pulses required for revolving the second planetary gear 62 by an angle $A_5$°;

$P_2$=number of pulses corresponding to an angle $A_4$° through which the non-toothed portion of the gear 57 is rotated from the position where it is opposed to the first planetary gear 53 to the position where it is opposed to the second planetary gear 62;

$P_3$=number of pulses corresponding to the rotation of the sheet supply roller 9 by the distance $L_4+\alpha$ ($\alpha$=2–5 mm);

$P_4$=number of pulses corresponding to the rotation of the sheet supply roller 9 by the distance $L_5+\alpha$ ($\alpha$=2–5 mm);

$P_5$=number of pulses corresponding to the rotation of the convey roller 13 by a distance $L_6$; and $P_6$=number of pulses corresponding to the rotation of the convey roller 13 by a distance greater than a longitudinal length of a maximum available sheet by two times.

The operation sequence of the motor M will now be described with reference to FIG. 24. The motor M starts to rotate at the "start". In a step S1, when the second planetary gear 62 is engaged by the gear 57, the motor M is stopped. Then, in a loop between a step S2 and a step S5, the motor M is rotated in the reverse direction until a count value T of a counter in a step S3 reaches a value $P_2$. During the reverse rotation of the motor M, when the photo-sensor PH is turned ON in a step S4, the count value T is checked in a step S6. In the step S6, if $T<P_3$, the sequence goes to a step S7, where the tip end of the sheet $S_1$ is urged against the contact position between the reversely rotating convey roller 13 and the first pinch rollers 16, thereby correcting the skew-feed of the sheet $S_1$.

Then, in a step S8, the motor M is rotated in the normal direction to convey the tip end of the sheet $S_1$ to the predetermined record position $L_6$. Thereafter, the image is recorded on the sheet $S_1$ by the recording operation which will be described later.

In the step S6, if it is judged as $T>P_3$, even when the operation of the step S7 is effected, the tip end of the sheet $S_1$ does not often reach the nip 77. That is to say, when $P_2=(P_3+P_4)$, if $T>P_3$, since the non-toothed portion 57*a* of the gear 57 is opposed to the second planetary gear 62 as shown in FIG. 4 during the rotation of the motor M by the pulse number $P_4$, the sheet supply roller 9 is stopped so that the sheet supply roller 9 cannot convey the sheet by an amount smaller than the pulse number $P_4$. Such a phenomenon will occur when the sheet supplying force of the sheet supply roller is reduced due to the low coefficient $\mu$ of friction of the sheet so that the sheet supply roller supplies the sheet while slipping on the sheet.

In the step S6, if it is judged that $T>P_3$, steps S9 and S10 are effected so that the tip end of the sheet is once penetrated into the contact position of the convey roller 13. Thereafter, in a step S11, when the convey roller is rotated reversely by the pulse number $P_5$, the sheet $S_1$ is returned toward the sheet supply roller so that the tip end of the sheet $S_1$ is positioned near the contact position 77. After the step S11 is effected, the sequence directly goes to the step S1. In this case, since the photo-sensor PH was already turned ON by the sheet $S_1$, the sequence goes from the step S4 to the step S6. In the step S6, since $T>P_3$, the sequence goes to the step S7 and then goes to a step S8, where the normal recording operation is performed.

Even when $T=P_2$ in the step S5, if the photo-sensor is not turned ON in the step S4, the sequence goes to a step S12, where the motor M is rotated in the normal direction by the pulse number $(P_3+P_4)$. Then, in a step S13, if the photo-sensor PH is not turned ON, it is judged that the sheet is jammed at an upstream side of the photo-sensor PH, and the control mode is changed to a sheet supply error mode.

The controller 34 displays the sheet supply error by using an LED display means or liquid crystal display means provided on the operation electric substrate 33 of FIG. 2 and informs the operator of the error by a buzzer or an alarm. The operator can retract the sheet on the sheet stacking plate 4 on the basis of the error display, and ascertain whether the tip end(s) of the sheet(s) is bent or folded. After the sheets are correctly rested on the sheet stacking plate 4 again, the sheet supplying operation is re-started.

In the step S13, if the photo-sensor PH is turned ON, it is judged that the tip end of the sheet $S_1$ is positioned at a downstream side of the photo-sensor PH. Then, in a step S14, the motor M is rotated by the pulse number $P_6$ to completely discharge the sheet out of the recording apparatus. Then, in a step S15, it is judged whether the sheet is present or absent. If the photo-sensor PH is not turned ON, it is judged that the sheet discharge is completed, thereby permitting the next sheet supply.

On the other hand, if the photo-sensor PH is turned ON, it is judged that the sheet is caught (jammed) anywhere at the downstream side of the photo-sensor PH so that the sheet cannot be discharged by the rotation of the convey roller, with the result that the control mode is changed to the error mode. The operator can retract the sheet on the sheet stacking plate 4 on the basis of the error display, and ascertain whether the tip end(s) of the sheet(s) is bent or folded. After the sheets are correctly rested on the sheet stacking plate 4 again, the sheet supplying operation is re-started.

What is claimed is:

1. A sheet supply apparatus comprising:

sheet supporting means for supporting sheets;

sheet supply means for positively contacting the sheet supported by said sheet supporting means and for feeding out the supported sheet;

release means for releasing contact between said sheet supply means and the sheet;

separation means for separating the sheets fed by said sheet supply means one by one;

a pair of convey rotary means for conveying the sheet separated by said separation means; and control means for effecting control such that, after the sheet separated by said separation means is conveyed by a predetermined amount by said convey rotary means, in a condition that the contact between said sheet supply means and the sheet is released by said release means, the sheet is conveyed in a reverse direction by said convey rotary means until a tip end of the sheet leaves a nip of said convey rotary means, and then the sheet is sent toward the nip of said convey rotary means by said sheet supply means to urge the tip end of the sheet against the nip of said convey rotary means which are now rotated in a reverse direction.

2. A sheet supply apparatus according to claim 1, wherein said control means effects control such that, after the tip end of the sheet abuts against the nip of said convey rotary means, the sheet is conveyed toward a downstream direction by rotating said sheet supply means and said convey rotary means in a normal direction.

3. A sheet supply apparatus according to claim 1, wherein said sheet supporting means has an intermediate plate biased toward said sheet supply means by biasing means, and said release means comprises cam means for separating said intermediate plate from said sheet supply means in opposition to said biasing means.

4. A sheet supply apparatus according to claim 1, wherein said sheet supply means comprises a sheet supply roller including a large diameter portion for feeding out the sheet and a small diameter portion having a diameter smaller than that of the large diameter portion, and said release means includes the small diameter portion so that, when the small diameter portion is opposed to the sheet supported by said sheet supporting means, the contact between said sheet supply means and the sheet is released.

5. A sheet supply apparatus according to claim 1, further comprising a reversible motor for causing said convey rotary means to convey the sheet either in the normal direction or in the reverse direction, and drive transmitting means for converting two directional rotations of said motor to a rotation for rotating said sheet supply roller in the normal direction, and for transmitting the converted rotation to said sheet supply means.

6. A sheet supply apparatus according to claim 5, wherein said drive transmitting means comprises a pair of planetary gears connected to said motor and a gear selectively engageable with one of said planetary gears so that, when one of the two directional rotations of said motor is transmitted, one of said planetary gears is engaged by said gear to transmit the rotation for feeding out the sheet to said sheet supply means, and, when the other of the two directional rotations of said motor is transmitted, the other of said planetary gears is engaged by said gear to transmit the rotation for feeding out the sheet to said sheet supply means.

7. A sheet supply apparatus according to claim 1, wherein said separation means comprises a thin plate-shaped member against which the sheet fed by said sheet supply means abuts to cause elastic angular displacement of the sheet and is adapted to permit separation of the sheet when the sheet rides over said thin plate-shaped member, and said thin plate-shaped member is disposed in an inclined manner so that, prior to the angular displacement of the sheet, an abutment surface of said thin plate-shaped member against which the sheet abuts has an end on which the sheet rides over and which is disposed nearer to said sheet supporting means than a surface portion of said abutment surface perpendicular to a sheet supplying direction.

8. A recording apparatus comprising:

sheet supporting means for supporting sheets;

sheet supply means for positively contacting the sheet supported by the sheet supporting means and for feeding out the sheet;

release means for releasing the contact between said sheet supply means and the sheet;

separation means for separating the sheets fed by said sheet supply means one by one;

a pair of convey rotary means for conveying the sheet separated by said separation means;

recording means for effecting recording with respect to the sheet conveyed by said convey rotary means; and control means for effecting control such that, after the sheet separated by said separation means is conveyed by a predetermined amount by said convey rotary means, in a condition that the contact between said sheet supply means and the sheet is released by said release means, the sheet is conveyed in a reverse direction by said convey rotary means until a tip end of the sheet leaves a nip of said convey rotary means, and then the sheet is sent toward the nip of said convey rotary means by said sheet supply means to urge the tip end of the sheet against the nip of said convey rotary means which are now rotated in a reverse direction.

9. A recording apparatus according to claim 8, wherein said recording means is of an ink jet recording type in which an electrical/thermal converter is energized in response to a signal, and recording is performed by discharging ink due to growth of a bubble generated in the ink by heating exceeding film boiling effected by the electrical/thermal converter.

10. A sheet supply apparatus comprising:

sheet supporting means for supporting sheets;

sheet supply means for positively contacting the sheet supported by the sheet supporting means and for feeding out the sheet;

separation means for separating the sheets fed by said sheet supply means one by one;

a pair of convey rotary means for conveying the sheet separated by said separation means;

release means for releasing the contact between said sheet supply means and the sheet after conveyance of the sheet is started by said convey rotary means;

sheet detection means disposed at an upstream side of said convey rotary means and adapted to detect the sheet; and control means for re-starting the sheet supply when it is judged that a tip end of the sheet does not reach said convey rotary means upon releasing the contact between said sheet supply means and the sheet by said release means, on the basis of a detected result of said sheet detection means, wherein said control means controls the re-start of the sheet supply such that, after said sheet supply means is again urged against the sheet being fed to feed the sheet up to said convey rotary means and the sheet is conveyed by said convey rotary means by a predetermined amount, in a condition that the contact between said sheet supply means and the sheet is released by said release means the sheet is conveyed in a reverse direction by said convey rotary means until a tip end of the sheet passes through a nip of said convey rotary means, and then, said sheet supply means is again urged against the sheet to feed the sheet toward the nip of said convey rotary means which are now being rotated in the reverse direction, thereby abutting the tip end of the sheet against the nip.

11. A sheet supply apparatus according to claim 10, wherein said control means also effects control for correcting skew-feed of the sheet, and the skew-feed correction control is effected such that, after the sheet separated by said separation means is conveyed by said convey rotary means by a predetermined amount, in the condition that the contact between said sheet supply means and the sheet is released by said release means, the sheet is conveyed in the reverse direction by said convey rotary means until the tip end of the sheet passes through the nip of said convey rotary means, and then, said sheet supply means is again urged against the sheet to feed the sheet toward the nip of said convey rotary means which are now being rotated in the reverse direction, thereby abutting the tip end of the sheet against the nip to correct the skew-feed.

12. A sheet supply apparatus according to claim 10, wherein said control means also effects control for correcting skew-feed of the sheet, and the skew-feed correction control is effected such that the skew-feed is corrected by abutting the tip end of the sheet separated by said separation means against the nip of said convey rotary means which are now being rotated in the reverse direction.

13. A sheet supply apparatus according to claim 10, wherein said control means stops the sheet supply if the sheet is not detected by said sheet detection means when said sheet supply means performs the operation for feeding out the sheet by the predetermined amount.

14. A recording apparatus comprising:

sheet supporting means for supporting sheets;

sheet supply means for positively contacting the sheet supported by the sheet supporting means and for feeding out the sheet ;

separation means for separating the sheets fed by said sheet supply means one by one;

a pair of convey rotary means for conveying the sheet separated by said separation means;

recording means for effecting recording with respect to the sheet conveyed by said convey rotary means;

release means for releasing the contact between said sheet supply means and the sheet after conveyance of the sheet is started by said convey rotary means;

sheet detection means disposed at an upstream side of said convey rotary means and adapted to detect the sheet; and control means for re-starting the sheet supply when it is judged that a tip end of the sheet does not reach said convey rotary means upon releasing the contact between said sheet supply means and the sheet by said release means, on the basis of a detected result of said sheet detection mean, wherein said control means controls the re-start of the sheet supply such that, after said sheet supply means is again urged against the sheet being fed to feed the sheet up to said convey rotary means and the sheet is conveyed by said convey rotary means by a predetermined amount, in a condition that the contact between said sheet supply means and the sheet is released by said release means, the sheet is conveyed in a reverse direction by said convey rotary means until a tip end of the sheet passes through a nip of said convey rotary means, and then, said sheet supply means is again urged against the sheet to feed the sheet toward the nip of said convey rotary means which are now being rotated in the reverse direction, thereby abutting the tip end of the sheet against the nip.

15. A recording apparatus according to claim 14, wherein said recording means is of an ink jet recording type in which an electrical/thermal converter is energized in response to a signal, and recording is performed by discharging ink due to growth of a bubble generated in the ink by heating exceeding film boiling effected by the electrical/thermal converter.

* * * * *

UNITED STATES PATENT AND TRADEMARK OFFICE

CERTIFICATE OF CORRECTION

PATENT NO. : 5,867,196

DATED : February 2, 1999

INVENTOR(S) : TAKEHIKO KIYOHARA, ET AL.

It is certified that error appears in the above-identified patent and that said Letters Patent is hereby corrected as shown below:

COLUMN 1,
Line 8, "sheet e.g.," should read --sheet (e.g.,--;
Line 10, "OHP sheet," should read --an OHP sheet,--; and
Line 26, "portion have" should read --portion, have--.

COLUMN 4,
Line 21, "is sectional" should read --is a sectional--; and
Line 46, "are" should read --is--.

COLUMN 5,
Line 18, "synchronous" should read --synchronism--.

COLUMN 21,
Line 36, "means the" should read --means, the--.

Signed and Sealed this

Seventh Day of September, 1999

*Attest:*

Q. TODD DICKINSON

*Attesting Officer*

*Acting Commissioner of Patents and Trademarks*